US011352705B2

(12) United States Patent
Hunter et al.

(10) Patent No.: US 11,352,705 B2
(45) Date of Patent: Jun. 7, 2022

(54) HYDROCARBON OXIDATION BY WATER OXIDATION ELECTROCATALYSTS IN NON-AQUEOUS SOLVENTS

(71) Applicant: CALIFORNIA INSTITUTE OF TECHNOLOGY, Pasadena, CA (US)

(72) Inventors: Bryan M. Hunter, Pasadena, CA (US); Harry B. Gray, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 142 days.

(21) Appl. No.: 15/675,065

(22) Filed: Aug. 11, 2017

(65) Prior Publication Data

US 2018/0044804 A1 Feb. 15, 2018

Related U.S. Application Data

(60) Provisional application No. 62/374,145, filed on Aug. 12, 2016.

(51) Int. Cl.
*C25B 3/07* (2021.01)
*C25B 3/23* (2021.01)
(Continued)

(52) U.S. Cl.
CPC ..... *C25B 11/091* (2021.01); *C25B 3/23* (2021.01); *C25B 11/051* (2021.01); *C25B 11/057* (2021.01)

(58) Field of Classification Search
CPC ..... C25B 3/02; C25B 3/07; C25B 3/23
(Continued)

(56) References Cited

U.S. PATENT DOCUMENTS 4,131,521 A * 12/1978 Cipris ..... C25B 3/23 205/439
4,277,318 A * 7/1981 Matlock ..... C25B 3/02 205/447

(Continued)

FOREIGN PATENT DOCUMENTS

| | | |
|---|---|---|
| EP | 0 339 523 B1 | 8/1992 |
| JP | H06-173055 A | 6/1994 |
| WO | WO 2005-067487 A2 | 7/2005 |

OTHER PUBLICATIONS

Scialdone et al., "Electrochemical Reduction of Carbon Dioxide to Formic Acid at a Tin Cathode in Divided and Undivided Cells: Effect of Carbon Dioxide Pressure and Other Operating Parameters," Electrochimica Acta (2016), vol. 199, pp. 332-341. (Year: 2016).*

(Continued)

*Primary Examiner* — Edna Wong
(74) *Attorney, Agent, or Firm* — Leydig, Voit & Mayer, Ltd.

(57) ABSTRACT

Processes and systems for oxidation of a hydrocarbon reactant to generate an oxidized hydrocarbon product may include: contacting a water oxidation electrocatalyst with the hydrocarbon reactant and water in the presence of a non-aqueous solvent; wherein an anodic bias is applied to the water oxidation electrocatalyst, thereby generating the oxidized hydrocarbon product; and wherein the water oxidation electrocatalyst comprises one or more transition metals other than Ru. Optionally, the water is provided in the non-aqueous solvent at a concentration less than or equal to 0.5 vol. %. Optionally, the magnitude of the anodic bias is selected to generate the oxidized hydrocarbon product characterized by selected product distribution.

28 Claims, 18 Drawing Sheets

(51) Int. Cl.
*C25B 11/091* (2021.01)
*C25B 11/051* (2021.01)
*C25B 11/057* (2021.01)

(58) Field of Classification Search
USPC ..... 205/413, 436, 440, 447, 449, 452, 439, 205/455, 459
See application file for complete search history.

(56) References Cited

U.S. PATENT DOCUMENTS

| | | | | |
|---|---|---|---|---|
| 4,496,440 | A * | 1/1985 | Campbell | C25B 3/23 205/426 |
| 4,990,227 | A | 2/1991 | Steiniger et al. | |
| 5,464,508 | A | 11/1995 | Hermeling et al. | |
| 2013/0118910 | A1* | 5/2013 | Teamey | C25B 1/00 205/427 |
| 2015/0021194 | A1 | 1/2015 | Sheehan et al. | |
| 2015/0368811 | A1 | 12/2015 | Gray et al. | |
| 2016/0010226 | A1 | 1/2016 | Dyballa et al. | |
| 2016/0152648 | A1 | 6/2016 | Bloomfield et al. | |

OTHER PUBLICATIONS

Axmann et al. (1997) "Nickel hydroxide as a matrix for unusual valencies: the electrochemical behaviour of metal(III)-ion-substituted nickel hydroxides of the pyroaurite type," J. Alloys Compd. 246(1-2):232-241.
Balasubramanian et al. (2000) "X-ray Absorption Spectroscopy Studies of the Local Atomic and Electronic Structure of Iron Incorporated into Electrodeposited Hydrous Nickel Oxide Films," J. Phys. Chem. B. 104(18):4300-4306.
Baltrusaitis et al. (2009) "XPS study of nitrogen dioxide adsorption on metal oxide particle surfaces under different environmental conditions," Phys. Chem. Chem. Phys. 11(37):8295-8305.
Bandis et al. (1999) "Photoelectron emission studies of cleaved and excimer laser irradiated single-crystal surfaces of NaNO3 and NaNO2," Surf. Sci. 442(3):413-419.
Bediako et al. (2012) "Structure-Activity Correlations in a Nickel-Borate Oxygen Evolution Catalyst," J. Am. Chem. Soc. 134(15):6801-6809.
Blakemore et al. (Oct. 3, 2013) "Co3O4 Nanoparticle Water-Oxidation Catalysts Made by Pulsed-Laser Ablation in Liquids," ACS Catal. 3(11):2497-2500.
Chen et al. (2010) "Nonaqueous Catalytic Water Oxidation," J. Am. Chem. Soc. 132:17670-17673.
Chen et al. (Feb. 17, 2014) "Inverse spinel NiFeAlO4 as a highly active oxygen evolution electrocatalyst: promotion of activity by a redox-inert metal ion," Energy Environ. Sci. 7(4):1382-1386.
Corrigan (1987) "The Catalysis of the Oxygen Evolution Reaction by Iron Impurities in Thin Film Nickel Oxide Electrodes," Electrochem. Soc. 134(2):377-384.
Corrigan et al. (1987) "In-situ Moessbauer study of redox processes in a composite hydroxide of iron and nickel," J. Phys. Chem. 91(19):5009-5011.
Dau et al. (2010) "The Mechanism of Water Oxidation: From Electrolysis via Homogeneous to Biological Catalysis," ChemCatChem. 2(7):724-761.
Demourgues-Guerlou (1995) "On the Iron Oxidation State in the Iron-Substituted γ Nickel Oxyhydroxides," J. Solid State Chem. 114:6-14.
Dincă et al. (2010) "Nickel-borate oxygen-evolving catalyst that functions under benign conditions," Proc. Natl. Acad. Sci. USA. 107(23):10337-10341.
Du et al. (2012) "Catalysts made of earth-abundant elements (Co, Ni, Fe) for water splitting: Recent progress and future challenges," Energy Environ. Sci. 5(3):6012-6021.
Frost et al. (2005) "Vibrational spectroscopic study of the nitrate containing hydrotalcite mbobomkulite," Spectrochim. Acta, Part A. 61(13-14):2919-2925.
Gao et al. (Apr. 25, 2014) "Efficient Water Oxidation Using Nanostructured α-Nickel-Hydroxide as an Electrocatalyst," J. Am. Chem. Soc. 136(19):7077-7084.
Gilbert et al. (1985) "Structure and redox properties of the water-oxidation catalyst [(bpy)2(OH2)RuORu(OH2)(bpy)2]4+," J. Am. Chem. Soc. 107(13):3855-3864.
Gong et al. (May 28, 2013) "An advanced Ni—Fe layered double hydroxide electrocatalyst for water oxidation," J. Am. Chem. Soc. 135:8452-8455.
Gray (2009) "Powering the planet with solar fuel," Nature Chem. 1(1):7.
Hall et al. (2012) "Raman and Infrared Spectroscopy of α and β Phases of Thin Nickel Hydroxide Films Electrochemically Formed on Nickel," J. Phys. Chem. A. 116(25):6771-6784.
Hannoyer et al. (1998) "Ferritization of Ni2+ ions in mixed hydroxide suspensions," Mater. Chem. Phys. 55(3):215-223.
Horn et al. (May 5, 2016) "Scalable and sustainable electrochemical allylic C—H oxidation," Nature. 533:77-81.
Hunter et al. (Oct. 31, 2016) "Earth-Abundant Heterogeneous Water Oxidation Catalysts," Chem. Rev. 116:14120-14136.
Hunter et al. (Sep. 8, 2014) "Highly Active Mixed-Metal Nanosheet Water Oxidation Catalysts Made by Pulsed-Laser Ablation in Liquids," J. Am. Chem. Soc. 136:13118-13121.
Kawamata et al. (May 16, 2017) "Scalable, Electrochemical Oxidation of Unactivated C—H Bonds," J. Am. Chem. Soc. 139:7448-7451.
Kermarec et al. (1994) "FTIR Identification of the Supported Phases Produced in the Preparation of Silica-Supported Nickel Catalysts," J. Phys. Chem. 98(46):12008-12017.
Landon et al. (2012) "Spectroscopic Characterization of Mixed Fe—Ni Oxide Electrocatalysts for the Oxygen Evolution Reaction in Alkaline Electrolytes," ACS Catal. 2:1793-1801.
Lewis et al. (2006) "Powering the planet: Chemical challenges in solar energy utilization," Proc. Natl. Acad. Sci. USA. 103(43):15729-15735.
Li et al. (2011) "Nickel based electrocatalysts for oxygen evolution in high current density, alkaline water electrolysers," Phys. Chem. Chem. Phys. 13(3):1162-1167.
Limburg et al. (1997) "O2 Evolution and Permanganate Formation from High-Valent Manganese Complexes," J. Am. Chem. Soc. 119(11):2761-2762.
Long et al. (Jun. 6, 2014) "A strongly coupled graphene and FeNi double hydroxide hybrid as an excellent electrocatalyst for the oxygen evolution reaction," Angew. Chem., Int. Ed. 53(29):7584-7588.
Louie et al. (Jul. 16, 2013) "An Investigation of Thin-Film Ni—Fe Oxide Catalysts for the Electrochemical Evolution of Oxygen," J. Am. Chem. Soc. 135(33):12329-12337.
Lyons et al. (2012) "Redox, pH sensing and Electrolytic Water Splitting Properties of Electrochemically Generated Nickel Hydroxide Thin Films in Aqueous Alkaline Solution," Int. J. Electrochem. Sci. 7:11768-11795.
Man et al. (2011) "Universality in Oxygen Evolution Electrocatalysis on Oxide Surfaces," ChemCatChem. 3(7):1159-1165.
McCrory et al. (Oct. 30, 2013) "Benchmarking Heterogeneous Electrocatalysts for the Oxygen Evolution Reaction," J. Am. Chem. Soc. 135:16977-16987.
McKone et al. (Aug. 27, 2013) "Will Solar-Driven Water-Splitting Devices See the Light of Day?" Chem. Mater. 26(1):407-414.
Nanayakkara et al. (Dec. 3, 2013) "Surface Photochemistry of Adsorbed Nitrate: The Role of Adsorbed Water in the Formation of Reduced Nitrogen Species on α-Fe2O3 Particle Surfaces," J. Phys. Chem. A. 118(1):158-166.
Oliva et al. (1982) "Review of the structure and the electrochemistry of nickel hydroxides and oxy-hydroxides," J. Power Sources. 8(2):229-255.
Risch et al. (2011) "Nickel-oxido structure of a water-oxidizing catalyst film," Chem. Commun. 47(43):11912-11914.
Ruettinger et al. (2000) "O2 Evolution from the Manganese-Oxo Cubane Core Mn4O46+: A Molecular Mimic of the Photosynthetic Water Oxidation Enzyme?" J. Am. Chem. Soc. 122(42):10353-10357.

(56) References Cited

OTHER PUBLICATIONS

Sheehan et al. (Jul. 2016) "Heterogenized Molecular Iridium Complexes for Catalytic Water Oxidation and C—H Activation," The STREM Chemiker. XXIX(1):13-21.
Singh et al. (Sep. 2013) "Water oxidation catalysts based on abundant 1st row transition metals," Coord. Chem. Rev. 257(17-18):2607-2622.
Smith et al. (Jul. 24, 2013) "Water Oxidation Catalysis: Electrocatalytic Response to Metal Stoichiometry in Amorphous Metal Oxide Films Containing Iron, Cobalt, and Nickel," J. Am. Chem. Soc. 135(31):11580-11586.
Song et al. (Jul. 17, 2014) "Exfoliation of layered double hydroxides for enhanced oxygen evolution catalysis," Nat. Commun. 5:4477. pp. 1-9.
Trasatti (1984) "Electrocatalysis in the anodic evolution of oxygen and chlorine," Electrochim. Acta. 29:1503-1512.
Trolard et al. (2012) "Fougerite a Natural Layered Double Hydroxide in Gley Soil: Habitus, Structure, and Some Properties," Ch. 9 In; Clay Minerals in Nature Their Characterization, Modification and Application. Eds.: Valaskova et al. InTechOpen. Ostrava, Czech Republic, pp. 171-188.
Trotochaud et al. (2012) "Solution-Cast Metal Oxide Thin Film Electrocatalysts for Oxygen Evolution," J. Am. Chem. Soc. 134(41):17253-17261.
Trotochaud et al. (Apr. 16, 2014) "Nickel-Iron Oxyhydroxide Oxygen-Evolution Electrocatalysts: The Role of Intentional and Incidental Iron Incorporation," J. Am. Chem. Soc. 136(18):6744-6753.
United States Geological Survey (Last Modified May 17, 2005) "Rare Earth Elements—Critical Resources for High Technology," United States Geological Survey Fact Sheet 087-02. Accessible ont the Internet at URL: https://pubs.usgs.gov/fs/2002/fs087-02, 12 pgs. [Last Accessed Jan. 19, 2018].
Vannucci et al. (2012) "Nonaqueous Electrocatalytic Oxidation of the Alkylaromatic Ethylbenzene by a Surface Bound RuV(O) Catalyst," ACS Catal. 2(5):716-719.
Walter et al. (2010) "Solar Water Splitting Cells," Chem. Rev. 110(11):6446-6473.
Wang et al. (Jan. 24, 2013) "Investigation of the role of anions in hydrotalcite for quasi-solid state dye-sensitized solar cells application," J. Mater. Chem. A. 1(13):4345-4351.
Wei et al. (2006) "Study on the Photochromism of Ni—Al Layered Double Hydroxides Containing Nitrate Anions," Eur. J. Inorg. Chem. 2006(14):2831-2838.
Wiechen et al. (2012) "Layered manganese oxides for water-oxidation: alkaline earth cations influence catalytic activity in a photosystem II—like fashion," Chem. Sci. 3(7):2330-2339.
Yang et al. (2007) "Laser ablation in liquids: Applications in the synthesis of nanocrystals," Prog. Mater. Sci. 52(4):648-698.
Yin et al. (2010) "A fast soluble carbon-free molecular water oxidation catalyst based on abundant metals," Science. 328(5976):342-345.
Zhao et al. (Oct. 23, 2013) "NiTi-Layered double hydroxides nanosheets as efficient photocatalysts for oxygen evolution from water using visible light," Chem. Sci. 5:951-958.
International Search Report with Written Opinion corresponding to International Patent Application No. PCT/US2017/046503, dated Nov. 27, 2017.

* cited by examiner

HYDROCARBON OXIDATION BY WATER OXIDATION ELECTROCATALYSTS IN NON-AQUEOUS SOLVENTS

CROSS-REFERENCE TO RELATED APPLICATIONS

This application claims the benefit of priority from U.S. Patent Application No. 62/374,145 filed Aug. 12, 2016, the content of which is hereby incorporated by reference to the extent not inconsistent herewith.

STATEMENT REGARDING FEDERALLY SPONSORED RESEARCH OR DEVELOPMENT

This invention was made with government support under Grant No. CHE1305124 awarded by the National Science Foundation. The government has certain rights in the invention.

BACKGROUND OF INVENTION

Selective and scalable oxidation of carbon-hydrogen bonds to carbon-oxygen bonds would have significant, potentially revolutionary, implications for many industries. This process is referred to as hydrocarbon oxidation or hydrocarbon activation. The promise and the goal is controllable, inexpensive, and scalable transformation of relatively inexpensive hydrocarbons into more valuable products, such as fine chemicals used in the production of pharmaceuticals, biopharmaceuticals, agrochemicals, and research chemicals. Particular hydrocarbon oxidation processes may be further useful in the formation reactions of complex chemical products, in addition to the production of the feedstock materials.

Oxidation of the carbon-hydrogen bond is a significant challenge due to its chemical inertness. Conventional methods, therefore, tend to utilize highly energy intensive processes (e.g., high temperatures), highly reactive but also highly toxic reagents, expensive platinum-group metal catalysts (Ru, Rh, Pd, Os, Ir, and/or Pt), and/or expensive to make and handle organometallic catalysts. Though hydrocarbons react at high temperatures, this may lead to undesirable products, particularly $CO_2$ and water. Typical hydrocarbon oxidation methods, therefore, rely on catalysis, particularly non-electrochemical homogeneous catalysts. Conventional hydrocarbon oxidation methods have had limited success, however, with primary challenges being selectivity (including over oxidation to undesired products or $CO_2$) and cost (including expensive raw materials and/or production of excessive contaminated water).

Emerging methods for hydrocarbon oxidation employ heterogeneous catalysts and/or electrochemical processes. Heterogeneous catalysts are advantageous at least because of facile recovery of the catalyst. Electrochemical hydrocarbon oxidation offers additional chemical mechanisms. However, these emerging methods are also limited by relying on expensive materials (e.g., organometallic catalysts containing platinum-group metal(s)), having poor selectivity, having limited parameter space (i.e., low tunability), and/or requiring aqueous solvents (which may limit choice of reactants and/or products).

Provided herein are processes and systems for hydrocarbon oxidation that address the above, and other, issues.

SUMMARY OF THE INVENTION

Provided herein are processes and systems for oxidation of one or more hydrocarbon reactants to generate one or more oxidized hydrocarbon products. These processes and systems may be highly selective, highly tunable, scalable, and inexpensive. These processes and systems further include water oxidation electrocatalyst(s) and non-aqueous solvent(s). In an example, water oxidation electrocatalyst(s) may be selected according to the desired hydrocarbon reactant(s) and/or oxidized hydrocarbon product(s). In other examples, the water oxidation electrocatalyst(s) are compatible with a variety of reactants and functional groups. In other examples, any one or more of a variety of non-aqueous solvents may be selected according to compatibility with the desired reactant(s) and/or product(s). Other examples of the tunability, selectivity, and scalability of these processes and systems are also provided herein. Water oxidation electrocatalysis useful for some applications may, for example, include one or more earth abundant metals and/or transition metals other than Ru. These processes and systems include an anodic bias applied to the water oxidation electrocatalyst(s). In some of the embodiments disclosed herein, the water oxidation electrocatalyst(s) selectivity and/or activity may be tuned via the magnitude of the applied anodic bias and/or the oxidation reaction time. Therefore, for example, in some of the embodiments disclosed herein, the oxidized hydrocarbon product distribution may be tuned as desired by changing the magnitude of the applied anodic bias. Some of the processes and systems disclosed herein may utilize low water concentrations, for example, less than 0.5 vol. %.

In an aspect, a process for oxidation of a hydrocarbon reactant to generate an oxidized hydrocarbon product comprises contacting a water oxidation electrocatalyst with the hydrocarbon reactant and water in the presence of a non-aqueous solvent. In an embodiment of this aspect, an anodic bias is applied to the water oxidation electrocatalyst, thereby generating the oxidized hydrocarbon product. In an embodiment of this aspect, the water oxidation electrocatalyst comprises one or more transition metals other than Ru. In an embodiment of this aspect, for example, the water oxidation electrocatalyst does not comprise Ru.

In an aspect, a process for oxidation of a hydrocarbon reactant to generate an oxidized hydrocarbon product comprises contacting a water oxidation electrocatalyst with the hydrocarbon reactant and water in the presence of a non-aqueous solvent. In an embodiment of this aspect, an anodic bias is applied to the water oxidation electrocatalyst, thereby generating the oxidized hydrocarbon product and the water is provided in the non-aqueous solvent at a concentration less than or equal to 0.5 vol. %. In a further embodiment of this aspect, the water oxidation electrocatalyst may comprise one or more transition metals other than Ru. In an embodiment of this aspect, for example, the water oxidation electrocatalyst does not comprise Ru.

In an aspect, a process for oxidation of a hydrocarbon reactant to generate an oxidized hydrocarbon product characterized by a selected product distribution comprises: contacting a water oxidation electrocatalyst with the hydrocarbon reactant and water in the presence of a non-aqueous solvent, and applying an anodic bias to the water oxidation electrocatalyst. In an embodiment of this aspect, the magnitude of the anodic bias is selected to generate the oxidized hydrocarbon product characterized by selected product distribution. In a further embodiment of this aspect, the water oxidation electrocatalyst may comprise one or more transition metals other than Ru. In an embodiment of this aspect, for example, the water oxidation electrocatalyst does not comprise Ru.

A variety of one or more water oxidation electrocatalyst, such as those described below, may be used in aspects or embodiments of the processes and systems disclosed herein. For example, certain water oxidation electrocatalyst(s) may be selected according to the desired reactant(s) and/or product(s), and further according to compatibility with the selected non-aqueous solvent. This is one example of the tunability of the hydrocarbon oxidation processes and systems disclosed herein. In an embodiment of some of the processes disclosed herein, for example, more than one water oxidation electrocatalyst may be used.

In an embodiment of some of the processes disclosed herein, for example, the water oxidation electrocatalyst may comprise one or more transition metals other than Ru. In an embodiment, for example, the water oxidation electrocatalyst does not comprise Ru. In an embodiment of some of the processes disclosed herein, for example, the water oxidation electrocatalyst comprises an inorganic catalyst. In an embodiment of some of the processes disclosed herein, for example, the water oxidation electrocatalyst is a metal oxide or a metal hydroxide. In an embodiment of some of the processes disclosed herein, for example, the water oxidation electrocatalyst is a metal oxide or metal hydroxide that comprises one or more earth abundant metals. In an embodiment of some of the processes disclosed herein, for example, the water oxidation electrocatalyst is a metal oxide or metal hydroxide that comprises one or more metals selected from the group consisting of Ni, Fe, Co, Mn, Zn, Sc, V, Cr, Cu, Ti, or a lanthanide. In an embodiment of some of the processes disclosed herein, for example, the water oxidation electrocatalyst is a layered ionic solid. In an embodiment of some of the processes disclosed herein, for example, the water oxidation electrocatalyst is a layered ionic solid that is a layered double hydroxide. In an embodiment of some of the processes disclosed herein, for example, the water oxidation electrocatalyst is a layered double hydroxide solid that comprises a Ni hydroxide, an Fe hydroxide, or a Ni—Fe hydroxide. In an embodiment of some of the processes disclosed herein, for example, the water oxidation electrocatalyst is a layered double hydroxide solid that is nanostructured. In an embodiment of some of the processes disclosed herein, for example, the water oxidation electrocatalyst is a layered double hydroxide solid that is generated via pulse laser ablation in liquid. In an embodiment of some of the processes disclosed herein, for example, the water oxidation electrocatalyst is other than an organometallic catalyst. In an embodiment of some of the processes disclosed herein, for example, the water oxidation electrocatalyst is a heterogeneous catalyst. In an embodiment of some of the processes disclosed herein, for example, the water oxidation electrocatalyst is a perovskite, a polyoxometalate, or a metal-organic framework. In an embodiment, for example, the water oxidation electrocatalyst is a solid, such as solid particles having physical dimensions less than or equal to 100 μm, or optionally less than or equal to 10 μm, or optionally less than or equal to 1 μm. In an embodiment, for example, the water oxidation electrocatalyst is a nanostructured solid, such as a solid having nano-features with dimensions less than or equal to 1 um, or optionally less than or equal to 200 nm.

In an embodiment of some of the processes disclosed herein, for example, the water oxidation electrocatalyst is provided on an electrode at a loading density of 1 $\mu g/cm^2$ to 1 $g/cm^2$. In an embodiment of some of the processes disclosed herein, for example, the water oxidation electrocatalyst is provided in the form of nanoparticles. In an embodiment of some of the processes disclosed herein, for example, the water oxidation electrocatalyst is provided in the form of nanoparticles that have an average diameter selected from the range of 1 nm to 1 μm, or optionally 1 nm to 200 nm, or optionally 2 nm to 20 nm, or optionally 5 nm to 15 nm.

The processes and systems described herein may be highly selective and tunable with regard to the ability to perform oxidation of any one or more of a variety of hydrocarbon reactants, and produce a desired oxidized hydrocarbon product. Further, in some embodiments and examples, the processes and systems disclosed herein may be compatible with reactants (e.g., perform carbon-hydrogen bond oxidation) that are otherwise incompatible with conventional hydrocarbon oxidation methods due to competing functional groups.

In an embodiment of some of the processes disclosed herein, for example, the hydrocarbon reactant comprises a substituted or unsubstituted: $C_1$-$C_{10}$ alkyl, $C_3$-$C_{10}$ cycloalkyl, $C_5$-$C_{10}$ aryl, $C_5$-$C_{10}$ heteroaryl, $C_1$-$C_{10}$ acyl, $C_1$-$C_{10}$ hydroxyl, $C_1$-$C_{10}$ alkoxy, $C_2$-$C_{10}$ alkenyl, $C_2$-$C_{10}$ alkynyl, $C_5$-$C_{10}$ alkylaryl, $C_3$-$C_{10}$ arylene, $C_3$-$C_{10}$ heteroarylene, $C_2$-$C_{10}$ alkenylene, $C_3$-$C_{10}$ cylcoalkenylene, $C_2$-$C_{10}$ alkynylene, ammonium ion, or any combination thereof. In an embodiment of some of the processes disclosed herein, for example, the hydrocarbon reactant comprises a substituted or unsubstituted: $C_1$-$C_{10}$ alkyl, $C_3$-$C_{10}$ cycloalkyl, $C_5$-$C_{10}$ aryl, $C_5$-$C_{10}$ heteroaryl, $C_1$-$C_{10}$ acyl, $C_1$-$C_{10}$ hydroxyl, $C_1$-$C_{10}$ alkoxy, $C_2$-$C_{10}$ alkenyl, $C_2$-$C_{10}$ alkynyl, $C_5$-$C_{10}$ alkylaryl, $C_3$-$C_{10}$ arylene, $C_3$-$C_{10}$ heteroarylene, $C_2$-$C_{10}$ alkenylene, $C_3$-$C_{10}$ cylcoalkenylene, $C_2$-$C_{10}$ alkynylene, or any combination thereof.

In an embodiment of some of the processes disclosed herein, for example, the hydrocarbon reactant comprises a phosphate ion, a hexafluorophosphate ion, an amine, an imine, a carbonyl, an ether, a nitrile, or a combination of any of these functional groups.

In an embodiment of some of the processes disclosed herein, for example, the hydrocarbon reactant is toluene, cyclohexane, cyclohexene, diphenylmethane, (2-chloroethyl)benzene, styrene, 9,10-dihydroanthracene, m-toluidine, methyl 5-methoxy-salicylate, 2-methylpentane, cyclohexanol, pentachlorobiphenyl, PCB 101, tetramethylammonium hexafluorophosphate, or any combination thereof.

In an embodiment of some of the processes disclosed herein, for example, the oxidized hydrocarbon product comprises an alcohol, an ether, an epoxide, a ketone, a carboxylic acid, an aldehyde, an acid chloride, an organic acid anhydride, or a combination of these.

In an embodiment of some of the processes disclosed herein, for example, the hydrocarbon reactant is provided in the non-aqueous solvent at a concentration selected from the range of 0.5 mM to 0.5 M, or optionally, for some embodiments, 1 mM to 0.5 M, or optionally, for some embodiments, 10 mM to 0.5 M, or optionally, for some embodiments, 1 mM to 0.1 M, or optionally, for some embodiments, 10 mM to 0.5 M, or optionally, for some embodiments, 100 mM to 0.5 M, or optionally, for some embodiments, 10 mM to 0.1 M.

The processes and systems described herein may be compatible with a variety of concentrations of water, which is provided in the non-aqueous solvent.

In an embodiment of some of the processes disclosed herein, for example, the water is provided in the non-aqueous solvent at a concentration less than or equal to 1 vol. %, or optionally, for some embodiments, less than or equal to 0.5 vol. %. In an embodiment of some of the processes disclosed herein, for example, the water is provided in the non-aqueous solvent at a concentration selected from the range of 0.1 vol. % to 5 vol. %. In an embodiment of some of the processes disclosed herein, for example, the water is characterized by a pH that is greater than 7, or optionally greater than or equal to 7.5, or optionally greater than or equal to 8.

The processes and systems disclosed herein may be compatible with a variety of non-aqueous solvents. The ability to select a non-aqueous solvent is one example of the tunability of these hydrocarbon oxidation processes and systems. For example, the non-aqueous solvent may be selected based on the desired reactant(s) and/or products and may further be selected according to the miscibility properties of the desired reactant(s) and/or product(s).

In an embodiment of some of the processes disclosed herein, for example, the non-aqueous solvent is provided in liquid phase at a temperature selected from the range of −78° C. to 100° C. In an embodiment of some of the processes disclosed herein, for example, the non-aqueous solvent is a liquid at normal temperature and pressure (NTP).

In an embodiment of some of the processes disclosed herein, for example, the non-aqueous solvent is a polar non-aqueous solvent. In an embodiment of some of the processes disclosed herein, for example, the non-aqueous solvent is a polar aprotic solvent.

In an embodiment of some of the processes disclosed herein, for example, the non-aqueous solvent is oxidatively stable under an applied voltage greater than 1.5 V vs. normal hydrogen electrode (NHE). In an embodiment of some of the processes disclosed herein, for example, the non-aqueous solvent is oxidatively stable under an applied voltage than 1.5 V and less than or equal to 3.2 V vs. normal hydrogen electrode (NHE).

In an embodiment of some of the processes disclosed herein, for example, the non-aqueous solvent has a dielectric constant greater than 10. In an embodiment of some of the processes disclosed herein, for example, the non-aqueous solvent has a dipole moment greater than 1.5 debye.

In an embodiment of some of the processes disclosed herein, for example, the non-aqueous solvent is acetonitrile, nitromethane, dichloromethane, propylene carbonate, liquid-$SO_2$, dimethyl formamide, ionic liquid, perfluorinated liquid, or any combinations thereof.

Some of the processes and systems disclosed herein may further include a supporting electrolyte. In an embodiment of some of the processes disclosed herein, for example, the step of contacting may be carried out in the presence of a supporting electrolyte is provided in the non-aqueous solvent. In an embodiment of some of the processes disclosed herein, for example, the supporting electrolyte is oxidatively stable under an applied voltage greater than 1.5 V vs. normal hydrogen electrode (NHE). In an embodiment of some of the processes disclosed herein, for example, the supporting electrolyte is oxidatively stable under an applied voltage greater than 1.5 V and less than or equal to 3.2 V vs. normal hydrogen electrode (NHE).

In an embodiment of some of the processes disclosed herein, for example, the supporting electrolyte is a periodate salt, a perchlorate salt, a tetraalkylammonium salt, a hexafluorophosphate salt, or any combinations thereof.

In an embodiment of some of the processes disclosed herein, for example, the supporting electrolyte is provided in the non-aqueous solvent at a concentration selected from the range of 10 mM to 100 mM.

The processes and systems disclosed herein may be further characterized by certain electrochemical parameters. For example, in some of the embodiments, these processes and systems may be compatible with a variety of anodic bias magnitudes and ranges thereof. The ability to apply different anodic bias magnitudes at the water oxidation electrocatalyst(s) is one example of the tunability of the processes and system disclosed herein. In some embodiments, for example, the advantages of the processes and systems disclosed herein may be further demonstrated by tunability of the selectivity and/or activity of certain water oxidation electrocatalysts via tuning of the anodic bias and/or oxidation time.

In an embodiment of some of the processes disclosed herein, for example, the anodic bias is greater than or equal 0.5 V vs. normal hydrogen electrode (NHE).

In an embodiment of some of the processes disclosed herein, for example, the anodic bias is in the range of 0.5 V to 5 V vs. normal hydrogen electrode (NHE). In an embodiment of some of the processes disclosed herein, for example, the anodic bias is in the range of 0.5 V to 3.2 V vs. normal hydrogen electrode (NHE).

In an embodiment of some of the processes disclosed herein, for example, the anodic bias is applied for a reaction time selected to generate the oxidized hydrocarbon product characterized by selected product distribution. For example, in these embodiments, the selectivity and/or activity of the water oxidation electrocatalyst(s) may be tuned via reaction time. In an embodiment, for example, the reaction time is greater than or equal to 10 seconds. In an embodiment, for example, the reaction time is greater than or equal to 1 minute. In an embodiment, for example, the reaction time is greater than or equal to 10 minutes. In an embodiment, for example, the reaction time is greater than or equal to 30 minutes. In an embodiment, for example, the reaction time is less than or equal to 60 minutes. In an embodiment, for example, the reaction time is less than or equal to 180 minutes. In an embodiment, for example, the reaction time is in the range of 1 minute to 180 minutes. In an embodiment, for example, the reaction time is in the range of 30 minutes to 180 minutes.

In an embodiment of some of the processes disclosed herein, for example, the water oxidation electrocatalyst is immobilized on an anode. In an embodiment of some of the processes disclosed herein, for example, the anode comprises fluorine-doped tin oxide (FTO), indium tin oxide (ITO), an allotrope of carbon, a metal, or any combination thereof.

In an embodiment of some of the processes disclosed herein, for example, a cathode is provided in contact with the non-aqueous solvent. In an embodiment of some of the processes disclosed herein, for example, the cathode comprises platinum, nickel, carbon, titanium, gold, or any a combination thereof.

In an embodiment of some of the processes disclosed herein, for example, the hydrocarbon reactant comprises a C—H bond. During oxidation, the C—H bond is oxidized to a C—O bond or a C═O.

The systems disclosed herein may include any combination of features and embodiments of the processes described herein.

In an aspect, a flow-through system for oxidation of a hydrocarbon reactant to generate an oxidized hydrocarbon product comprises: a non-aqueous solvent; the hydrocarbon reactant provided in the non-aqueous solvent; water provided in the non-aqueous solvent; a working electrode at least partially provided in a non-aqueous solvent; a water oxidation electrocatalyst immobilized on the working electrode and in contact with the oxidized hydrocarbon product and the water; and a counter electrode at least partially provided in the non-aqueous solvent and electrically connected to the working electrode. In an embodiment of this aspect, an anodic bias is applied to the working electrode, thereby generating the oxidized hydrocarbon product. In a further embodiment of this aspect, the non-aqueous solvent continuously flows through the system. In a further embodiment of this aspect, the water oxidation electrocatalyst comprises one or more transition metals other than Ru. In an embodiment of this aspect, for example, the water oxidation electrocatalyst does not comprise Ru. In an embodiment of this aspect, for example, the system further comprises a reference electrode.

Without wishing to be bound by any particular theory, there may be discussion herein of beliefs or understandings of underlying principles relating to the systems and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIGS. 6A and 6B illustrate exemplary systems that may be used to perform the hydrocarbon oxidation processes corresponding to FIGS. 1-4, and 8-13.

FIG. 7 is based on United States Geological Survey Fact Sheet 087-02, FIG. 4, available at https://pubs.usgs.gov/fs/2002/fs087-02/ (last accessed Aug. 2, 2017).

STATEMENTS REGARDING CHEMICAL COMPOUNDS AND NOMENCLATURE

Figure 1:
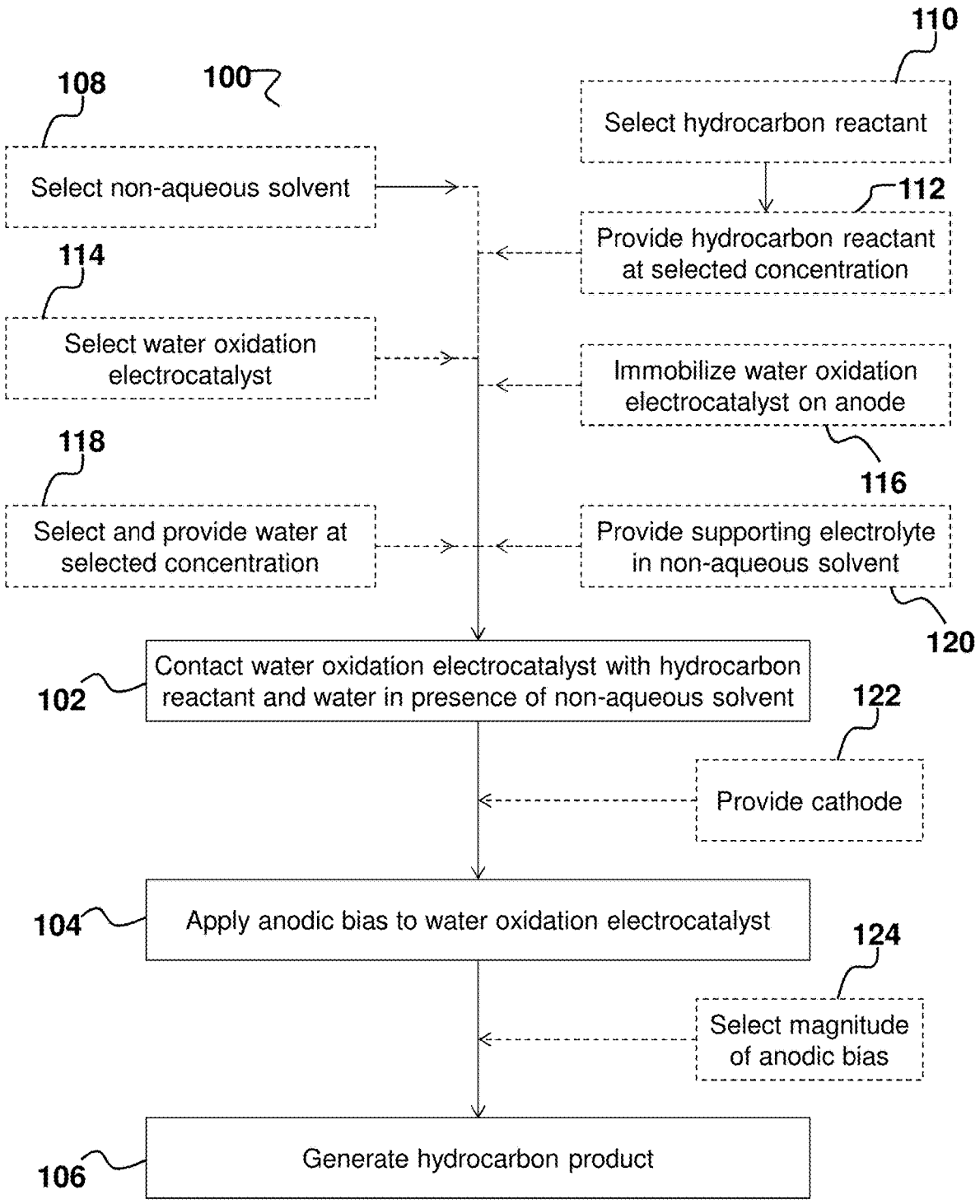
FIG. 1 is a flowchart summary of an exemplary method of hydrocarbon oxidation by water oxidation electrocatalysts in non-aqueous solvents.

In an embodiment, a composition or compound of the invention, such as a metal catalyst composition or formulation, is isolated or substantially purified. In an embodiment, an isolated or purified compound is at least partially isolated or substantially purified as would be understood in the art. In an embodiment, a substantially purified composition, compound or formulation of the invention has a chemical purity of 95%, optionally for some applications 99%, optionally for some applications 99.9%, optionally for some applications 99.99%, and optionally for some applications 99.999% pure.

Many of the molecules disclosed herein contain one or more ionizable groups. Ionizable groups include groups from which a proton can be removed (e.g., —COOH) or added (e.g., amines) and groups that can be quaternized (e.g., amines). All possible ionic forms of such molecules and salts thereof are intended to be included individually in the disclosure herein. With regard to salts of the compounds herein, one of ordinary skill in the art can select from among a wide variety of available counterions that are appropriate for preparation of salts of this invention for a given application. In specific applications, the selection of a given anion or cation for preparation of a salt can result in increased or decreased solubility of that salt.

The compounds of this invention can contain one or more chiral centers. Accordingly, this invention is intended to include racemic mixtures, diastereomers, enantiomers, tautomers and mixtures enriched in one or more stereoisomer. The scope of the invention as described and claimed encompasses the racemic forms of the compounds as well as the individual enantiomers and non-racemic mixtures thereof.

As used herein, the term "group" may refer to a functional group of a chemical compound. Groups of the present compounds refer to an atom or a collection of atoms that are a part of the compound. Groups of the present invention may be attached to other atoms of the compound via one or more covalent bonds. Groups may also be characterized with respect to their valence state. The present invention includes groups characterized as monovalent, divalent, trivalent, etc. valence states.

As used herein, the term "substituted" refers to a compound wherein a hydrogen is replaced by another functional group, including, but not limited to: hydroxide (—OH), carbonyl (RCOR'), sulfide (e.g., RSR'), phosphate (ROP(═O)$(OH)_2$), azo (RNNR'), cyanate (ROCN), amine (e.g., primary, secondary, or tertiary), imine (RC(═NH)R'), nitrile (RCN), ether (ROR'), halogen or a halide group; where each of R and R' is independently a hydrogen or a substituted or unsubstituted alkyl group, aryl group, alkenyl group, or a combination of these. Optional substituent functional groups are also described below.

Alkyl groups include straight-chain, branched and cyclic alkyl groups. Alkyl groups include those having from 1 to 30 carbon atoms. Alkyl groups include small alkyl groups having 1 to 3 carbon atoms. Alkyl groups include medium length alkyl groups having from 4-10 carbon atoms. Alkyl groups include long alkyl groups having more than 10 carbon atoms, particularly those having 10-30 carbon atoms. The term cycloalkyl specifically refers to an alky group having a ring structure such as ring structure comprising 3-30 carbon atoms, optionally 3-20 carbon atoms and optionally 2-10 carbon atoms, including an alkyl group having one or more rings. Cycloalkyl groups include those having a 3-, 4-, 5-, 6-, 7-, 8-, 9- or 10-member carbon ring(s) and particularly those having a 3-, 4-, 5-, 6-, 7- or 8-member ring(s). The carbon rings in cycloalkyl groups can also carry alkyl groups. Cycloalkyl groups can include bicyclic and tricycloalkyl groups. Alkyl groups are optionally substituted. Substituted alkyl groups include among others those which are substituted with aryl groups, which in turn can be optionally substituted. Specific alkyl groups include methyl, ethyl, n-propyl, iso-propyl, cyclopropyl, n-butyl, s-butyl, t-butyl, cyclobutyl, n-pentyl, branched-pentyl, cyclopentyl, n-hexyl, branched hexyl, and cyclohexyl groups, all of which are optionally substituted. Substituted alkyl groups include fully halogenated or semihalogenated alkyl groups, such as alkyl groups having one or more hydrogens replaced with one or more fluorine atoms, chlorine atoms, bromine atoms and/or iodine atoms. Substituted alkyl groups include fully fluorinated or semifluorinated alkyl groups, such as alkyl groups having one or more hydrogens replaced with one or more fluorine atoms. Substituted alkyl groups may include substitution to incorporate one or more silyl groups, for example wherein one or more carbons are replaced by Si.

An alkoxy group is an alkyl group that has been modified by linkage to oxygen and can be represented by the formula R—O and can also be referred to as an alkyl ether group. Examples of alkoxy groups include, but are not limited to, methoxy, ethoxy, propoxy, butoxy and heptoxy. Alkoxy groups include substituted alkoxy groups wherein the alky portion of the groups is substituted as provided herein in connection with the description of alkyl groups. As used herein MeO— refers to $CH_3O$—.

Alkenyl groups include straight-chain, branched and cyclic alkenyl groups. Alkenyl groups include those having 1, 2 or more double bonds and those in which two or more of the double bonds are conjugated double bonds. Alkenyl groups include those having from 2 to 20 carbon atoms. Alkenyl groups include small alkenyl groups having 2 to 3 carbon atoms. Alkenyl groups include medium length alkenyl groups having from 4-10 carbon atoms. Alkenyl groups include long alkenyl groups having more than 10 carbon atoms, particularly those having 10-20 carbon atoms. Cycloalkenyl groups include those in which a double bond is in the ring or in an alkenyl group attached to a ring. The term cycloalkenyl specifically refers to an alkenyl group having a ring structure, including an alkenyl group having a 3-, 4-, 5-, 6-, 7-, 8-, 9- or 10-member carbon ring(s) and particularly those having a 3-, 4-, 5-, 6-, 7- or 8-member ring(s). The carbon rings in cycloalkenyl groups can also carry alkyl groups. Cycloalkenyl groups can include bicyclic and tricyclic alkenyl groups. Alkenyl groups are optionally substituted. Substituted alkenyl groups include among others those that are substituted with alkyl or aryl groups, which groups in turn can be optionally substituted. Specific alkenyl groups include ethenyl, prop-1-enyl, prop-2-enyl, cyclo-prop-1-enyl, but-1-enyl, but-2-enyl, cyclobut-1-enyl, cyclobut-2-enyl, pent-1-enyl, pent-2-enyl, branched pentenyl, cyclopent-1-enyl, hex-1-enyl, branched hexenyl, cyclohexenyl, all of which are optionally substituted. Substituted alkenyl groups include fully halogenated or semihalogenated alkenyl groups, such as alkenyl groups having one or more hydrogens replaced with one or more fluorine atoms, chlorine atoms, bromine atoms and/or iodine atoms. Substituted alkenyl groups include fully fluorinated or semifluorinated alkenyl groups, such as alkenyl groups having one or more hydrogen atoms replaced with one or more fluorine atoms.

Aryl groups include groups having one or more 5-, 6-, 7- or 8-member aromatic rings, including heterocyclic aromatic rings. The term heteroaryl specifically refers to aryl groups having at least one 5-, 6-, 7- or 8-member heterocyclic aromatic rings. Aryl groups can contain one or more fused aromatic rings, including one or more fused heteroaromatic rings, and/or a combination of one or more aromatic rings and one or more nonaromatic rings that may be fused or linked via covalent bonds. Heterocyclic aromatic rings can include one or more N, O, or S atoms in the ring. Heterocyclic aromatic rings can include those with one, two or three N atoms, those with one or two O atoms, and those with one or two S atoms, or combinations of one or two or three N, O or S atoms. Aryl groups are optionally substituted. Substituted aryl groups include among others those that are substituted with alkyl or alkenyl groups, which groups in turn can be optionally substituted. Specific aryl groups include phenyl, biphenyl groups, pyrrolidinyl, imidazolidinyl, tetrahydrofuryl, tetrahydrothienyl, furyl, thienyl, pyridyl, quinolyl, isoquinolyl, pyridazinyl, pyrazinyl, indolyl, imidazolyl, oxazolyl, thiazolyl, pyrazolyl, pyridinyl, benzoxadiazolyl, benzothiadiazolyl, and naphthyl groups, all of which are optionally substituted. Substituted aryl groups include fully halogenated or semihalogenated aryl groups, such as aryl groups having one or more hydrogens replaced with one or more fluorine atoms, chlorine atoms, bromine atoms and/or iodine atoms. Substituted aryl groups include fully fluorinated or semifluorinated aryl groups, such as aryl groups having one or more hydrogens replaced with one or more fluorine atoms. Aryl groups include, but are not limited to, aromatic group-containing or heterocylic aromatic group-containing groups corresponding to any one of the following: benzene, naphthalene, naphthoquinone, diphenylmethane, fluorene, anthracene, anthraquinone, phenanthrene, tetracene, tetracenedione, pyridine, quinoline, isoquinoline, indoles, isoindole, pyrrole, imidazole, oxazole, thiazole, pyrazole, pyrazine, pyrimidine, purine, benzimidazole, furans, benzofuran, dibenzofuran, carbazole, acridine, acridone, phenanthridine, thiophene, benzothiophene, dibenzothiophene, xanthene, xanthone, flavone, coumarin, azulene or anthracycline. As used herein, a group corresponding to the groups listed above expressly includes an aromatic or heterocyclic aromatic group, including monovalent, divalent and polyvalent groups, of the aromatic and heterocyclic aromatic groups listed herein provided in a covalently bonded configuration in the compounds of the invention at any suitable point of attachment. In embodiments, aryl groups contain between 5 and 30 carbon atoms. In embodiments, aryl groups contain one aromatic or heteroaromatic six-member ring and one or more additional five- or six-member aromatic or heteroaromatic ring. In embodiments, aryl groups contain between five and eighteen carbon atoms in the rings. Aryl groups optionally have one or more aromatic rings or heterocyclic aromatic rings having one or more electron donating groups, electron withdrawing groups and/or targeting ligands provided as substituents.

Arylalkyl groups are alkyl groups substituted with one or more aryl groups wherein the alkyl groups optionally carry additional substituents and the aryl groups are optionally substituted. Specific alkylaryl groups are phenyl-substituted alkyl groups, e.g., phenylmethyl groups. Alkylaryl groups are alternatively described as aryl groups substituted with one or more alkyl groups wherein the alkyl groups optionally carry additional substituents and the aryl groups are optionally substituted. Specific alkylaryl groups are alkyl-substituted phenyl groups such as methylphenyl. Substituted arylalkyl groups include fully halogenated or semihalogenated arylalkyl groups, such as arylalkyl groups having one or more alkyl and/or aryl groups having one or more hydrogens replaced with one or more fluorine atoms, chlorine atoms, bromine atoms and/or iodine atoms.

As used herein, the terms "alkylene" and "alkylene group" are used synonymously and refer to a divalent group derived from an alkyl group as defined herein. The invention includes compounds having one or more alkylene groups. Alkylene groups in some compounds function as attaching and/or spacer groups. Compounds of the invention may have substituted and/or unsubstituted $C_1$-$C_{20}$ alkylene, $C_1$-$C_{10}$ alkylene and $C_1$-$C_5$ alkylene groups.

As used herein, the terms "cycloalkylene" and "cycloalkylene group" are used synonymously and refer to a divalent group derived from a cycloalkyl group as defined herein. The invention includes compounds having one or more cycloalkylene groups. Cycloalkyl groups in some compounds function as attaching and/or spacer groups. Compounds of the invention may have substituted and/or unsubstituted $C_3$-$C_{20}$ cycloalkylene, $C_3$-$C_{10}$ cycloalkylene and $C_3$-$C_5$ cycloalkylene groups.

As used herein, the terms "arylene" and "arylene group" are used synonymously and refer to a divalent group derived from an aryl group as defined herein. The invention includes compounds having one or more arylene groups. In an embodiment, an arylene is a divalent group derived from an aryl group by removal of hydrogen atoms from two intra-ring carbon atoms of an aromatic ring of the aryl group. Arylene groups in some compounds function as attaching and/or spacer groups. Arylene groups in some compounds function as chromophore, fluorophore, aromatic antenna, dye and/or imaging groups. Compounds of the invention include substituted and/or unsubstituted $C_3$-$C_{30}$ arylene, $C_3$-$C_{20}$ arylene, $C_3$-$C_{10}$ arylene and $C_1$-$C_5$ arylene groups.

As used herein, the terms "heteroarylene" and "heteroarylene group" are used synonymously and refer to a divalent group derived from a heteroaryl group as defined herein. The invention includes compounds having one or more heteroarylene groups. In an embodiment, a heteroarylene is a divalent group derived from a heteroaryl group by removal of hydrogen atoms from two intra-ring carbon atoms or intra-ring nitrogen atoms of a heteroaromatic or aromatic ring of the heteroaryl group. Heteroarylene groups in some compounds function as attaching and/or spacer groups. Heteroarylene groups in some compounds function as chromophore, aromatic antenna, fluorophore, dye and/or imaging groups. Compounds of the invention include substituted and/or unsubstituted $C_3$-$C_{30}$ heteroarylene, $C_3$-$C_{20}$ heteroarylene, $C_1$-$C_{10}$ heteroarylene and $C_3$-$C_5$ heteroarylene groups.

As used herein, the terms "alkenylene" and "alkenylene group" are used synonymously and refer to a divalent group derived from an alkenyl group as defined herein. The invention includes compounds having one or more alkenylene groups. Alkenylene groups in some compounds function as attaching and/or spacer groups. Compounds of the invention include substituted and/or unsubstituted $C_2$-$C_{20}$ alkenylene, $C_2$-$C_{10}$ alkenylene and $C_2$-$C_5$ alkenylene groups.

As used herein, the terms "cylcoalkenylene" and "cylcoalkenylene group" are used synonymously and refer to a divalent group derived from a cylcoalkenyl group as defined herein. The invention includes compounds having one or more cylcoalkenylene groups. Cycloalkenylene groups in some compounds function as attaching and/or spacer groups. Compounds of the invention include substituted and/or unsubstituted $C_3$-$C_{20}$ cylcoalkenylene, $C_3$-$C_{10}$ cylcoalkenylene and $C_3$-$C_5$ cylcoalkenylene groups.

As used herein, the terms "alkynylene" and "alkynylene group" are used synonymously and refer to a divalent group derived from an alkynyl group as defined herein. The invention includes compounds having one or more alkynylene groups. Alkynylene groups in some compounds function as attaching and/or spacer groups. Compounds of the invention include substituted and/or unsubstituted $C_2$-$C_{20}$ alkynylene, $C_2$-$C_{10}$ alkynylene and $C_2$-$C_5$ alkynylene groups.

As used herein, the term "halo" refers to a halogen group such as a fluoro (—F), chloro (—Cl), bromo (—Br), iodo (—I) or astato (—At).

The term "heterocyclic" refers to ring structures containing at least one other kind of atom, in addition to carbon, in the ring. Examples of such heteroatoms include nitrogen, oxygen and sulfur. Heterocyclic rings include heterocyclic alicyclic rings and heterocyclic aromatic rings. Examples of heterocyclic rings include, but are not limited to, pyrrolidinyl, piperidyl, imidazolidinyl, tetrahydrofuryl, tetrahydrothienyl, furyl, thienyl, pyridyl, quinolyl, isoquinolyl, pyridazinyl, pyrazinyl, indolyl, imidazolyl, oxazolyl, thiazolyl, pyrazolyl, pyridinyl, benzoxadiazolyl, benzothiadiazolyl, triazolyl and tetrazolyl groups. Atoms of heterocyclic rings can be bonded to a wide range of other atoms and functional groups, for example, provided as substituents.

The term "carbocyclic" refers to ring structures containing only carbon atoms in the ring. Carbon atoms of carbocyclic rings can be bonded to a wide range of other atoms and functional groups, for example, provided as substituents.

The term "alicyclic ring" refers to a ring, or plurality of fused rings, that is not an aromatic ring. Alicyclic rings include both carbocyclic and heterocyclic rings.

The term "aromatic ring" refers to a ring, or a plurality of fused rings, that includes at least one aromatic ring group. The term aromatic ring includes aromatic rings comprising carbon, hydrogen and heteroatoms. Aromatic ring includes carbocyclic and heterocyclic aromatic rings. Aromatic rings are components of aryl groups.

The term "fused ring" or "fused ring structure" refers to a plurality of alicyclic and/or aromatic rings provided in a fused ring configuration, such as fused rings that share at least two intra ring carbon atoms and/or heteroatoms.

As used herein, the term "alkoxyalkyl" refers to a substituent of the formula alkyl-O-alkyl.

As used herein, the term "polyhydroxyalkyl" refers to a substituent having from 2 to 12 carbon atoms and from 2 to 5 hydroxyl groups, such as the 2,3-dihydroxypropyl, 2,3,4-trihydroxybutyl or 2,3,4,5-tetrahydroxypentyl residue.

As used herein, the term "polyalkoxyalkyl" refers to a substituent of the formula alkyl-(alkoxy)n-alkoxy wherein n is an integer from 1 to 10, preferably 1 to 4, and more preferably for some embodiments 1 to 3.

As used herein, the term "ammonium ion" refers to a positively charged group having the formula $[NH_4]^+$. In some embodiments, for example, the ammonium ion is substituted, such that one or more of the hydrogens are replaced by another functional group, such as some those described above.

As used herein, the term "phosphate ion" refers to a negatively charged group having the formula $[PO_4]^{3-}$.

As used herein, the term "hexafluorophosphate ion" refers to a negatively charged group having the formula $[PF_6]^-$.

As to any of the groups described herein that contain one or more substituents, it is understood that such groups do not contain any substitution or substitution patterns which are sterically impractical and/or synthetically non-feasible. In addition, the compounds of this invention include all stereochemical isomers arising from the substitution of these compounds. Optional substitution of alkyl groups includes substitution with one or more alkenyl groups, aryl groups or both, wherein the alkenyl groups or aryl groups are optionally substituted. Optional substitution of alkenyl groups includes substitution with one or more alkyl groups, aryl groups, or both, wherein the alkyl groups or aryl groups are optionally substituted. Optional substitution of aryl groups includes substitution of the aryl ring with one or more alkyl groups, alkenyl groups, or both, wherein the alkyl groups or alkenyl groups are optionally substituted.

Optional substituents for any alkyl, alkenyl and aryl group includes substitution with one or more of the following substituents, among others:

halogen, including fluorine, chlorine, bromine or iodine;

pseudohalides, including —CN;

—COOR, where R is a hydrogen or an alkyl group or an aryl group and more specifically where R is a methyl, ethyl, propyl, butyl, or phenyl group all of which groups are optionally substituted;

—COR, where R is a hydrogen or an alkyl group or an aryl group and more specifically where R is a methyl, ethyl, propyl, butyl, or phenyl group all of which groups are optionally substituted;

—$CON(R)_2$, where each R, independently of each other R, is a hydrogen or an alkyl group or an aryl group and more specifically where R is a methyl, ethyl, propyl, butyl, or phenyl group all of which groups are optionally substituted; and where R and R can form a ring which can contain one or more double bonds and can contain one or more additional carbon atoms;

—$OCON(R)_2$, where each R, independently of each other R, is a hydrogen or an alkyl group or an aryl group and more specifically where R is a methyl, ethyl, propyl, butyl, or phenyl group all of which groups are optionally substituted; and where R and R can form a ring which can contain one or more double bonds and can contain one or more additional carbon atoms;

—$N(R)_2$, where each R, independently of each other R, is a hydrogen, or an alkyl group, or an acyl group or an aryl group and more specifically where R is a methyl, ethyl, propyl, butyl, phenyl or acetyl group, all of which are optionally substituted; and where R and R can form a ring that can contain one or more double bonds and can contain one or more additional carbon atoms;

—SR, where R is hydrogen or an alkyl group or an aryl group and more specifically where R is hydrogen, methyl, ethyl, propyl, butyl, or a phenyl group, which are optionally substituted;

—$SO_2R$, or —SOR, where R is an alkyl group or an aryl group and more specifically where R is a methyl, ethyl, propyl, butyl, or phenyl group, all of which are optionally substituted;

—OCOOR, where R is an alkyl group or an aryl group;

—$SO_2N(R)_2$, where each R, independently of each other R, is a hydrogen, or an alkyl group, or an aryl group all of which are optionally substituted and wherein R and R can form a ring that can contain one or more double bonds and can contain one or more additional carbon atoms; and —OR, where R is H, an alkyl group, an aryl group, or an acyl group all of which are optionally substituted. In a particular example R can be an acyl yielding —OCOR", wherein R" is a hydrogen or an alkyl group or an aryl group and more specifically where R" is methyl, ethyl, propyl, butyl, or phenyl groups all of which groups are optionally substituted.

Specific substituted alkyl groups include haloalkyl groups, particularly trihalomethyl groups and specifically trifluoromethyl groups. Specific substituted aryl groups include mono-, di-, tri, tetra- and pentahalo-substituted phenyl groups; mono-, di-, tri-, tetra-, penta-, hexa-, and hepta-halo-substituted naphthalene groups; 3- or 4-halo-substituted phenyl groups, 3- or 4-alkyl-substituted phenyl groups, 3- or 4-alkoxy-substituted phenyl groups, 3- or 4-RCO-substituted phenyl, 5- or 6-halo-substituted naphthalene groups. More specifically, substituted aryl groups include acetylphenyl groups, particularly 4-acetylphenyl groups; fluorophenyl groups, particularly 3-fluorophenyl and 4-fluorophenyl groups; chlorophenyl groups, particularly 3-chlorophenyl and 4-chlorophenyl groups; methylphenyl groups, particularly 4-methylphenyl groups; and methoxyphenyl groups, particularly 4-methoxyphenyl groups.

As used herein, "water oxidation electrocatalyst" refers to a class of catalyst materials capable of electrocatalytically oxidizing water to $O_2$. For some of the embodiments, a water oxidation electrocatalyst may also be a catalyst capable of oxidizing hydroxide (—OH) to oxygen ($O_2$). In some of the embodiments disclosed herein, water oxidation electrocatalyst may be a heterogeneous catalyst. In some of the embodiments disclosed herein, water oxidation electrocatalyst may comprise one or more metals other than Ru. In some of the embodiments disclosed herein, water oxidation electrocatalyst may comprise one or more transition metals other than Ru. In some of the embodiments disclosed herein, water oxidation electrocatalyst does not comprise Ru. In some of the embodiments disclosed herein, water oxidation electrocatalyst may comprise one or more transition metals other than a platinum-group metal, wherein platinum group metals are Ru, Rh, Pd, Os, Ir, and Pt. In some of the embodiments disclosed herein, water oxidation electrocatalyst may comprise an inorganic catalyst. In some of the embodiments disclosed herein, water oxidation electrocatalyst may be a metal oxide or a metal hydroxide. In some of the embodiments disclosed herein, water oxidation electrocatalyst may be a metal oxide or metal hydroxide comprising one or more earth abundant metals. In some of the embodiments disclosed herein, water oxidation electrocatalyst may be a metal oxide or metal hydroxide comprising one or more transition metals such as, but not limited to, Ni, Fe, Co, Mn, Zn, Sc, V, Cr, Cu, and Ti. In some of the embodiments disclosed herein, water oxidation electrocatalyst may be a metal oxide or metal hydroxide comprising one or more lanthanide metals. In some of the embodiments disclosed herein, water oxidation electrocatalyst may be a metal oxide or metal hydroxide comprising one or more lanthanide metals and one or more transition metals, such as, but not limited to, Ni, Fe, Co, Mn, Zn, Sc, V, Cr, Cu, and Zn. In some of the embodiments disclosed herein, water oxidation electrocatalyst may be catalyst that is not an organometallic catalyst. In some of the embodiments disclosed herein, water oxidation electrocatalyst may be a layered ionic solid (i.e., an ionic compound having a layered structure). In some of the embodiments disclosed herein, water oxidation electrocatalyst may be a perovskite, a polyoxometalate, or a metal-organic framework. In some of the embodiments disclosed herein, water oxidation electrocatalyst may be a layered double hydroxide. In some of the embodiments disclosed herein, water oxidation electrocatalyst may be a layered double hydroxide comprising nickel hydroxide. In some of the embodiments disclosed herein, water oxidation electrocatalyst may be an iron-doped layered double hydroxide comprising iron hydroxide. In some of the embodiments disclosed herein, water oxidation electrocatalyst may be an iron-doped layered double hydroxide comprising Ni—Fe hydroxide. In some of the embodiments disclosed herein, water oxidation electrocatalyst may be a layered double hydroxide doped with transition metal ion(s) (e.g., $Ti^{4+}$) and/or lanthanide metal ion(s) (e.g., $La^{3+}$). In some of the embodiments disclosed herein, water oxidation electrocatalyst may be a layered double hydroxide comprising Ni—Fe hydroxide and further doped with transition metal ion(s) (e.g., $Ti^{4+}$) and/or lanthanide metal ion(s) (e.g., $La^{3+}$). In some of the embodiments disclosed herein, water oxidation electrocatalyst may be a layered double hydroxide formed or generated via pulsed laser ablation in liquid. In some of the embodiments disclosed herein, water oxidation electrocatalyst may be nanostructured. In some of the embodiments disclosed herein, water oxidation electrocatalyst may be provided in the form of nanoparticles. In some of the embodiments disclosed herein, water oxidation electrocatalyst may be provided in the form of nanoparticles having an average diameter in the range of 1 nm to 1 μm, or optionally 2 nm to 20 nm.

Figure 7:
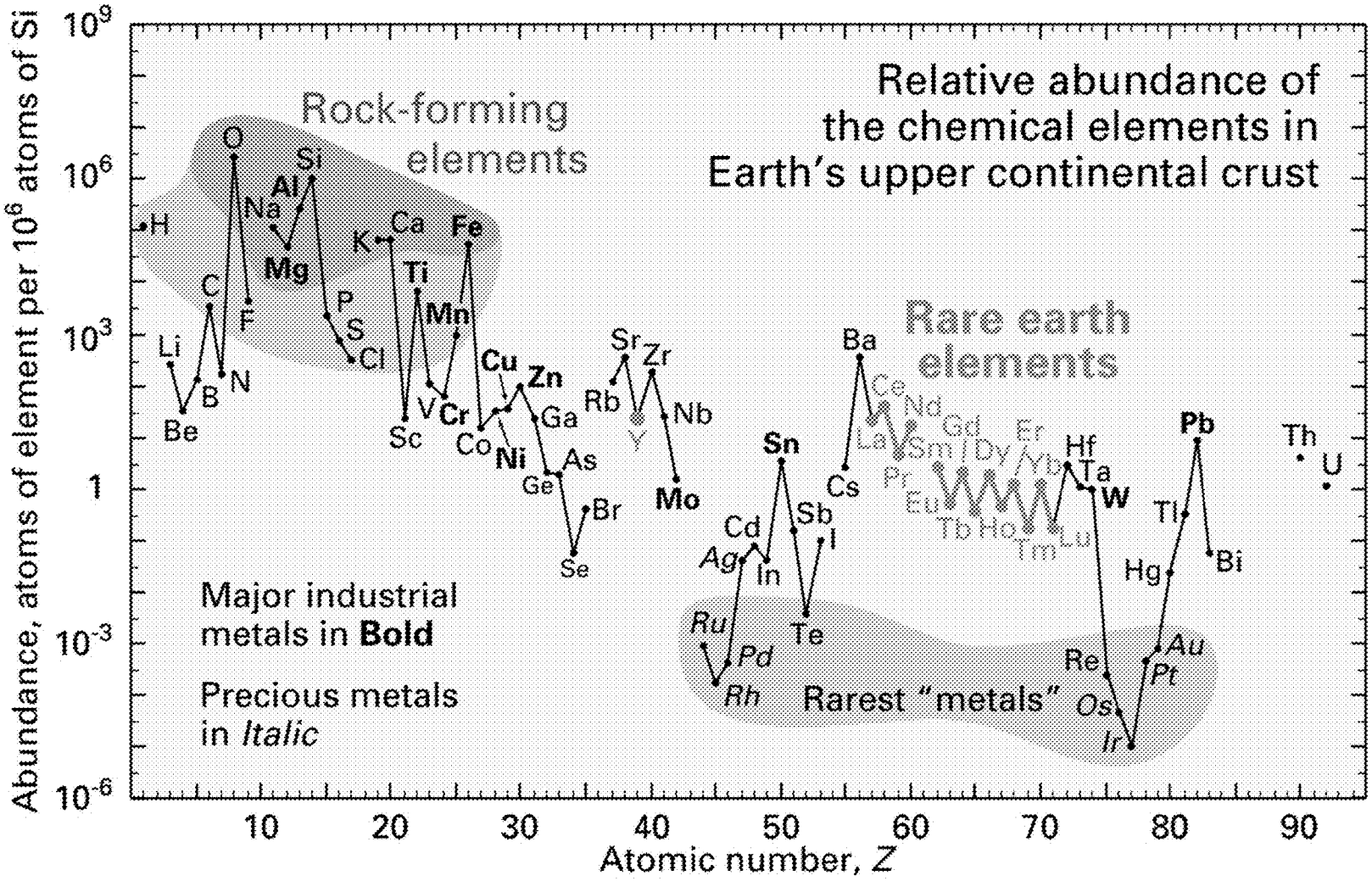
FIG. 7 is a chart showing the relative abundance of certain metal elements in the Earth's upper crust, represented as number of atoms of the element per $10^6$ atoms of Si.

The term "Earth abundant metal" refers to metallic elements that are abundant in the Earth's crust. As used herein, Earth abundant metals are those having a relative availability in the Earth's crust greater than or equal to $10^{-2}$ atoms per $10^6$ atoms of Si according to the chart shown in FIG. 7 (the source of which is United States Geological Survey Fact Sheet 087-02, FIG. 4, available at https://pubs.usgs.gov/fs/2002/fs087-02/; last accessed Aug. 2, 2017).

"Non-aqueous solvent" refers to a non-water liquid in which hydrocarbon reactant (e.g., toluene), and optionally the hydrocarbon product (e.g., benzaldehyde or benzyl alcohol), is dissolved. The non-aqueous solvent may include small amounts of water, such that the water is dissolved in the non-aqueous solvent. The non-aqueous solvent may include small amounts of water, such that a predominant phase of the solution is the non-water liquid and the hydrocarbon reactant remains substantially dissolved in the non-water phase. In some of the embodiments disclosed herein, non-aqueous solvent may be acetonitrile, nitromethane, dichloromethane, propylene carbonate, liquid sulfur dioxide (l-$SO_2$), dimethyl formamide, ionic liquid, perfluorinated liquid, or any combination of these.

"Hydrocarbon oxidation" refers to carbon-hydrogen (C—H) bond activation or carbon-hydrogen bond functionalization, which is a type of chemical reaction wherein the C—H bond is cleaved and replaced with a C—X bond, wherein X may be oxygen. The oxygen may be a constituent of a molecule, such that the carbon (C—) is bound to the molecule via the carbon-oxygen (C—O) bond. For example, hydroxylation is a form of hydrocarbon oxidation, wherein the H of the C—H bond is replaced with a hydroxyl group (C—OH) to generate an alcohol.

"Anodic bias" refers to a bias (i.e., potential or voltage) applied to an electrode, for example, such as a working electrode, such that conventional current flows into the electrode (i.e., the anode).

"Product distribution" refers to relative molar yield of possible reaction products. For example, oxidation of toluene may yield benzaldehyde, benzyl alcohol and/or benzoic acid. The product distribution is a measure of the relative yields of the latter three products (e.g., 40% benzaldehyde, 60% benzyl alcohol, and 0% benzoic acid).

"Reaction time" refers the time duration during which anodic bias is applied to the electrocatalyst, or working electrode having the electrocatalyst.

"Organometallic catalyst" refers to the class of catalysts whose chemical structure includes at least one chemical bond between a carbon atom of an organic compound and a metal ion.

"Platinum-group metal" refers to a metal or metal ion that is one of the six elements Ru, Rh, Pd, Os, Ir, and Pt.

"Layered ionic solid nanomaterial" refers to a solid material which has at least one dimension that is between 1 and 100 nm, has a layered structure (e.g., crystal structure), and is an ionic solid, which is defined a chemical, in solid form, having ions held together by ionic bonding. A "layered double hydroxide" is a class of materials having the formula $[M_{(1-x)}M'_x(OH)_2]^{x+}$ and having associated with or intercalating ions $[A^{m-}{}_{x/m}]$, wherein M is a metal cation in a formal +2 oxidation state (e.g., Ni), M' a metal cation in a formal +3 oxidation state (e.g., Fe), A is a displaceable anion (e.g., $NO_3^-$), x is a positive number less than 1 (e.g., 0.5 or less), and m is an integer (e.g., 1, 2, 3, or 4).

"Polar aprotic liquid" refers to a liquid that is polar, having a dipole moment greater than 1 debye, and that lacks an O—H bond and a N—H bond. In some of the embodiments disclosed herein, a polar aprotic liquid may have a dipole moment greater than or equal to 1.5 debye.

"Nanoparticles" refers to a material (e.g., water oxidation electrocatalyst) provided as solid particles with at least one size dimension in the range of 1 nm to 1 μm. Relevant examples of a size dimension include: length, width, diameter, volume-based diameter $$\left(2\sqrt[3]{\frac{3V}{4\pi}}\right),$$

area-based diameter $$\left(\sqrt[2]{\frac{4A}{\pi}}\right)r,$$

weight-based diameter $$\left(2\sqrt[3]{\frac{3W}{4\pi d g}}\right),$$

and hydrodynamic diameter; where V is nanoparticle volume, A is nanoparticle surface area, W is nanoparticle weight, d is nanoparticle density, and g is the gravitational constant. The nanoparticle volume, area, weight, and area each may be an average property reflective of the nanoparticle size distribution. Interaction among nanoparticles may lead to aggregation of the nanoparticles into larger aggregates, or clusters of nanoparticles. As used herein, the term "nanoparticle" is not intended to include a cluster or aggregate of nanoparticles. Aggregates of nanoparticles may be larger than the average diameter of the constituent nanoparticles, and may further be greater than 1 μm in size.

As used herein, the term "heterogeneous catalyst" refers to a catalyst provided in a different phase (i.e., solid, liquid, or gas) than that of the reactant(s). According to certain embodiments, a heterogeneous catalyst is immiscible or insoluble in the non-aqueous solvent. In an embodiment, for example, a heterogeneous catalyst is provided as a solid and the reactant(s) is provided as a liquid. According to certain embodiments, a "homogeneous catalyst" is catalyst that is soluble or miscible in the non-aqueous solvent, optionally chemically attached, tethered, linked, or anchored to a solid support to prevent solubilization or miscibility of the catalyst.

The term "normal temperature and pressure" or "NTP" refers to standard conditions defined as a temperature of 20° C. and an absolute pressure of 1 atm (14.696 psi, 101.325 kPa).

DETAILED DESCRIPTION OF THE INVENTION

In general, the terms and phrases used herein have their art-recognized meaning, which can be found by reference to standard texts, journal references and contexts known to those skilled in the art. The following definitions are provided to clarify their specific use in the context of the invention.

FIG. 1 is a flowchart illustrating one example method 100 for hydrocarbon oxidation by water oxidation electrocatalysts in non-aqueous solvents. Dashed lines within FIG. 1 represent optional steps. In step 102 of method 100, water oxidation electrocatalyst(s) 200 is contacted with a hydrocarbon reactant(s) 202 and water 204 in the presence of a non-aqueous solvent 206. In step 104 of method 100, anodic bias is applied to water oxidation electrocatalyst 200. Step 104 may be performed prior to, concurrently with, or after step 102. In step 106 of method 100, a hydrocarbon product(s) 208 is generated. Further in step 106, one or more C—H bonds of hydrocarbon reactant(s) 202 may be oxidized to a C—O (single) bond or a C═O (double) bond. Any or all of steps 102-106 may be repeated. In some of the embodiments disclosed herein, hydrocarbon product(s) 208 may comprise an alcohol, an ether, an epoxide, a ketone, a carboxylic acid, an aldehyde, an acid chloride, an organic acid anhydride, or a combination of these. Method 100 may further comprise: (i) isolating or removing hydrocarbon product(s) 208 and/or (ii) recovering the water oxidation electrocatalyst.

Each of steps 108-120 is independently optional. Any of steps 108-120 may be independently performed prior to, concurrently with, or after step 102. Any of steps 108-120, if performed, may be performed in any order. Any or all of steps 108-124 may be performed more than once. Optionally, any or all of steps 108-120 may be repeated in a different order.

In step 108 of method 100, non-aqueous solvent 206, in which steps 102-106 are performed, is selected. In some of the embodiments disclosed herein, the non-aqueous solvent may have a dielectric constant greater than 10. Non-aqueous solvent 206 may be a polar non-aqueous solvent, having a dipole moment greater than 1. Non-aqueous solvent 206 may be a polar non-aqueous solvent, having a dipole moment greater than or equal to 1.5 debye. Non-aqueous solvent 206 may be a polar aprotic solvent. To avoid or minimize unwanted degradation of the solvent, non-aqueous solvent 206 may be selected to be oxidatively (or, anodically) stable under an applied voltage greater than 1.5 V vs. normal hydrogen electrode (NHE). Additionally in step 108, non-aqueous solvent 206 is provided as a liquid and water oxidation electrocatalyst 200 is provided as a solid. Selected non-aqueous solvent 206 may be a liquid at normal temperature and pressure (NTP, 20° C. and 1 atm). Further in step 108, the temperature of non-aqueous solvent 206 is selected, for example, in the range of −78° C. (e.g., dry ice/acetone mixture) to 100° C. (e.g., boiling point of water). The temperature of solvent 206 is the temperature at which any one, two, or all of steps 102-106 are performed. The temperature of solvent 206 may affect catalyst 200 selectivity (and thereby hydrocarbon product 208 distribution) and may also affect the catalyst activity (i.e., rate of the oxidation reaction of hydrocarbon reactant(s) 202 to hydrocarbon product(s) 208).

In step 110 of method 100, hydrocarbon reactant(s) 202 is selected. One or more hydrocarbon reactants 202 may be selected in step 100. In some of the embodiments disclosed herein, hydrocarbon reactant(s) 202 may comprise a substituted or unsubstituted: $C_1$-$C_{10}$ alkyl, $C_3$-$C_{10}$ cycloalkyl, $C_5$-$C_{10}$ aryl, $C_5$-$C_{10}$ heteroaryl, $C_1$-$C_{10}$ acyl, $C_1$-$C_{10}$ hydroxyl, $C_1$-$C_{10}$ alkoxy, $C_2$-$C_{10}$ alkenyl, $C_2$-$C_{10}$ alkynyl, $C_5$-$C_{10}$ alkylaryl, $C_3$-$C_{10}$ arylene, $C_3$-$C_{10}$ heteroarylene, $C_2$-$C_{10}$ alkenylene, $C_3$-$C_{10}$ cylcoalkenylene, or $C_2$-$C_{10}$ alkynylene, ammonium ion, or any combination thereof. In some of the embodiments disclosed herein, hydrocarbon reactant(s) 202 may comprise a phosphate ion, a hexafluorophosphate ion, an amine, an imine, a carbonyl, an ether, a nitrile, or a combination of these functional groups Hydrocarbon reactant(s) 202 may be, for example, toluene, cyclohexane, cyclohexene, diphenylmethane, (2-chloroethyl)benzene, styrene, 9,10-dihydroanthracene, m-toluidine, methyl 5-methoxy-salicylate, 2-methylpentane, cyclohexanol, pentachlorobiphenyl, PCB 101 (i.e., 2,2',4,5,5'-pentachlorobiphenyl), tetramethylammonium hexafluorophosphate, any derivative of these, or any combination of these. In step 112 of method 100, hydrocarbon reactant(s) 202 is provided to non-aqueous solvent 206 at a selected concentration. In an example of step 112, hydrocarbon reactant(s) 202 concentration in non-aqueous solvent 206 is in the range of 0.5 mM to 0.5 M.

In step 114 of method 100, water oxidation electrocatalyst 200 is selected. Water oxidation electrocatalyst may be selected based on any one or more factors including, but not limited to, the selected hydrocarbon reactant(s) 202, the desired hydrocarbon product(s) 208, and the selected non-aqueous solvent 206. For example, a particular water oxidation electrocatalyst may be selected according to its ability to form a desired hydrocarbon product, and further according to the catalyst's compatibility with the selected hydrocarbon reactant, which may only be compatible with select non-aqueous solvents. Water oxidation electrocatalyst 200 may be selected according to any of the descriptions above. For example, water oxidation electrocatalyst 200 may comprise one or more transition metal other than Ru. In another example, water oxidation electrocatalyst is an inorganic catalyst. In another example, water oxidation electrocatalyst is a catalyst material other than an organometallic catalyst. In a further example of step 114, water oxidation electrocatalyst may be selected or provided in the form of nanoparticles, for example, having an average diameter selected from the range of 1 nm to 1 μm. For example, water oxidation electrocatalyst 200 may be an iron-doped nickel-based layered double hydroxide having the formula $[Ni_{1-x}Fe_x(OH)_2](NO_3)_y(OH)_{x-y}\cdot nH_2O]$, and optionally having additional ions such as $Ti^{4+}$ and/or $La^{3+}$, and optionally provided in the form of nanoparticles; wherein each of x and y independently is a positive number less than 1 (e.g., 0.5 or less) and n is a positive number (e.g., in the range of 0.5 and 4).

In step 116 of method 100, water oxidation electrocatalyst 200 is immobilized on an electrode 210. According to certain embodiments, electrode 210 is a working electrode 214. According to certain embodiments, working electrode 214 is an anode 216. In some of the embodiments disclosed herein, anode 216 may be fluorine-doped tin oxide (FTO), indium tin oxide (ITO), an allotrope of carbon (e.g., graphite, glassy carbon, carbon fiber, and/or pyrolytic carbon), a metal (e.g., Pt, Ti, Ni, Au, and/or a carbon allotrope), or any combination of these. In an example of step 116, water oxidation electrocatalyst is drop cast from a solution onto anode 216 and the drop-cast solution is allowed to dry, thereby immobilizing the solid water oxidation electrocatalyst on anode 216. In a further example of step 116, a suspension or a dispersion of water oxidation electrocatalyst 200 is first prepared, and the suspension or dispersion is then drop-cast onto anode 216. In other examples of step 116, water oxidation electrocatalyst 200 may be immobilized on anode 216 via a solution coating technique, a vapor deposition technique, or any other technique known in the art and appropriate to the selected water oxidation electrocatalyst 200, such as, but not limited to, doctor blading, dip coating, spin coating, electrophoretic deposition, pulsed laser ablation, pyrolysis, sputtering, thermal evaporation, and laser ablation. Water oxidation electrocatalyst 200 may be provided on electrode 210 (e.g., anode 212) at a selected loading density, for example selected over the range of 1 $\mu g/cm^2$ to 1 $g/cm^2$. Accordingly, in step 104, anodic bias may be applied to water oxidation electrocatalyst indirectly, that is, via applying anodic bias to anode 216, with which water oxidation electrocatalyst is in electronic communication and/or on which the water oxidation electrocatalyst is immobilized.

In step 118 of method 100, water 204 is provided in non-aqueous solvent 206 at a selected concentration. In some of the embodiments disclosed herein, water 204, before its addition to non-aqueous solvent 206, may have a pH greater than 7. In some of the embodiments disclosed herein, the concentration of water 204 in non-aqueous solvent 206 may be selected from the range of 0.1 vol. % (volume percent) to 5 vol. %. In some of the embodiments disclosed herein, the concentration of water 204 in non-aqueous solvent 206 may be less than or equal to 1 vol. %. In some of the embodiments disclosed herein, the concentration of water 204 in non-aqueous solvent 206 may be less than or equal to 0.5 vol. %.

In step 120 of method 100, supporting electrolyte 218 is selected and provided in non-aqueous solvent 206. In some of the embodiments disclosed herein, the concentration of supporting electrolyte 218 in non-aqueous solvent 206 may be selected from the range 10 mM to 100 mM. In some of the embodiments disclosed herein, supporting electrolyte 218 may be selected such that supporting electrolyte 218 is oxidatively (or, anodically) stable under an applied voltage greater than 1.5 V vs. NHE. An oxidatively stable supporting electrolyte is useful to prevent unwanted degradation of the supporting electrolyte during application of anodic bias and oxidation of the hydrocarbon reactant(s) (e.g., during steps 104-106). In some of the embodiments disclosed herein, example supporting electrolyte 218 include, but are not limited to, a periodate salt, a perchlorate salt, a tetraalkylammonium salt, a hexafluorophosphate salt, or any combination of these. Accordingly, step 102 may further be performed in the presence of supporting electrolyte 218.

Step 122 is optional. Step 122 may be performed concurrently with, before, or after step 102. In step 122 of method 100, a counter electrode 220 is provided in contact with non-aqueous solvent 206. In some of the embodiments disclosed herein, counter electrode 220 is a cathode 222. Cathode 222 may be directly and/or indirectly (e.g., via electrical device such as a potentiostat) in electrical communication and in ionic communication (e.g., via the solution having at least non-aqueous solvent 206 and hydrocarbon reactant 202) with anode 216. Cathode 222 may be platinum (e.g., in any form, such as platinum black), nickel, an allotrope of carbon, titanium, or any combination of these.

In relevant steps, water oxidation electrocatalyst 200 (and anode 216) may be provided in a reaction chamber that is separated from the chamber having counter electrode 220 (e.g., cathode 222; see step 122). Each of the anode- and cathode-containing chambers may include non-aqueous solvent 206, and optionally water 204, and optionally supporting electrolyte 218 (see step 118). The anode- and cathode-containing chambers may be separated by a salt bridge, which is a separator, such as a porous glass frit or a membrane, that allows transport of select ions and/or electrolytes and/or solvent compound(s) while blocking transport of, for example, hydrocarbon reactant(s) 202 and/or hydrocarbon product(s) 208. Alternatively, anode 216 (having water oxidation electrocatalyst 200) and cathode 222 may be provided in the same reaction chamber.

Figure 4:
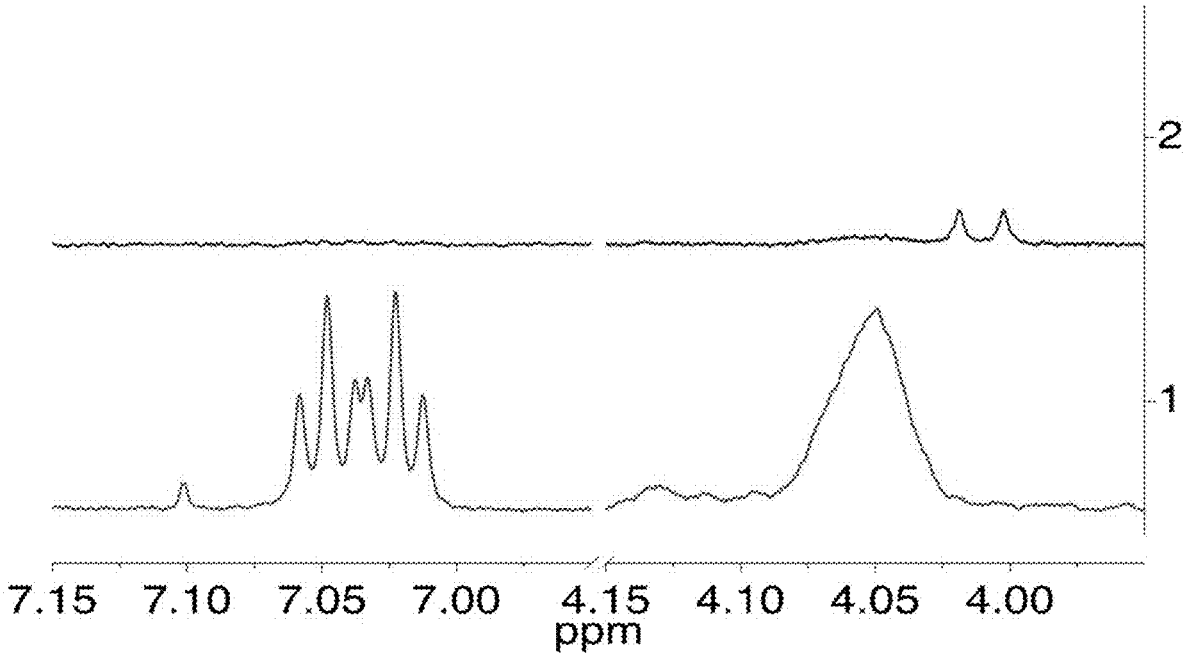
FIG. 4 Is NMR spectra showing cyclohexene after bulk electrolysis (2 hours) without (top) and with (bottom) catalyst at 1.8 V vs. $Ag/Ag^+$ in 0.1 M $LiClO_4$ in acetonitrile. The peak at ~7.05 ppm corresponds to cyclohexen-one, while the peak at ~4.05 ppm corresponds to cyclohexen-ol.
Figure 5:
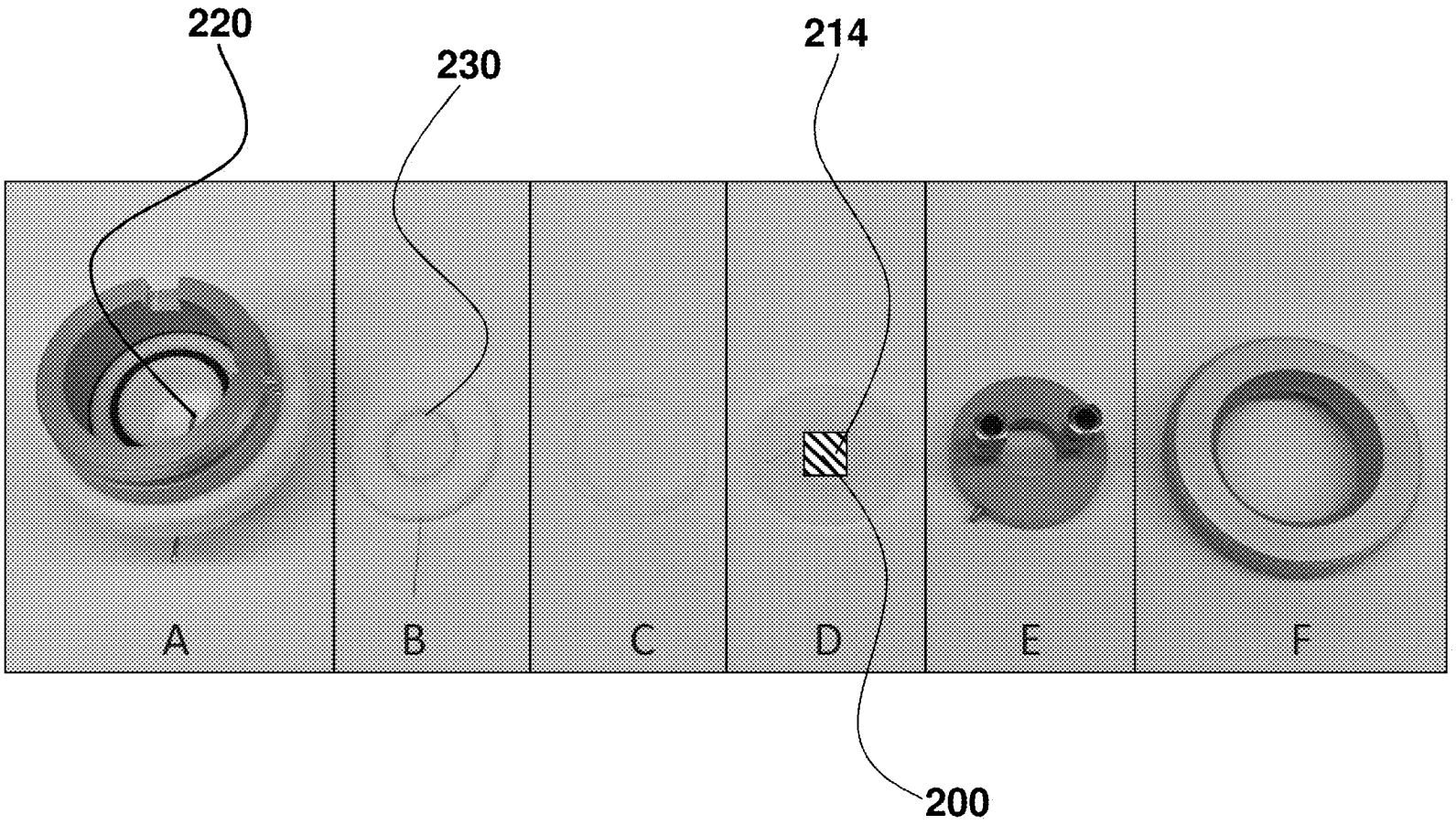
FIG. 5 panels (A), (B), (C), (D), (E), and (F) are exemplary flow-through electrocatalysis system components.
Figure 6A:
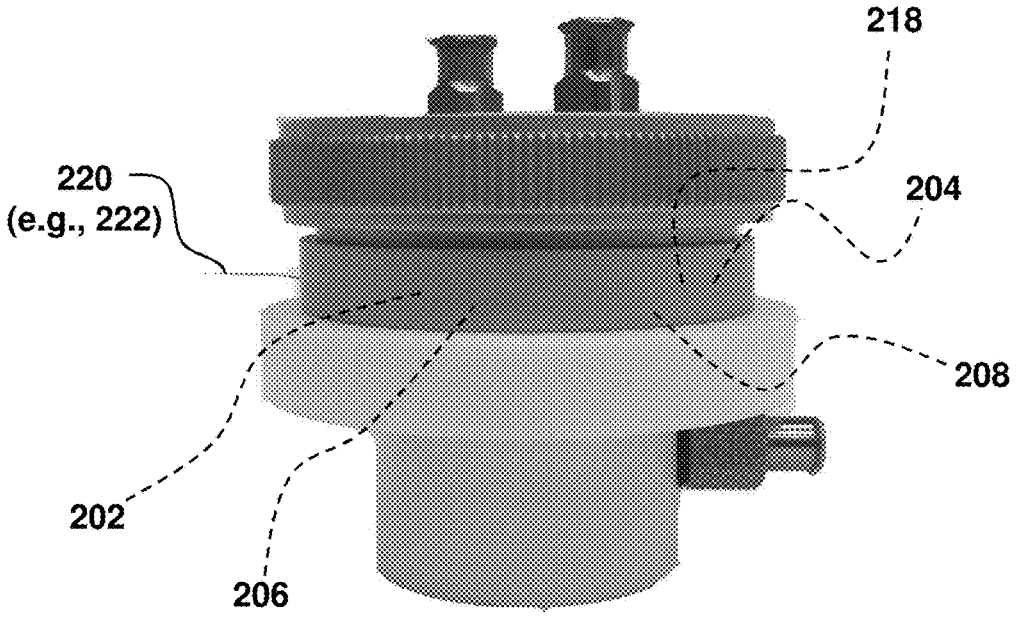
FIG. 6A is a photograph and FIG. 6B is a schematic of exemplary assembled flow-through electrocatalysis systems.
Figure 6B:
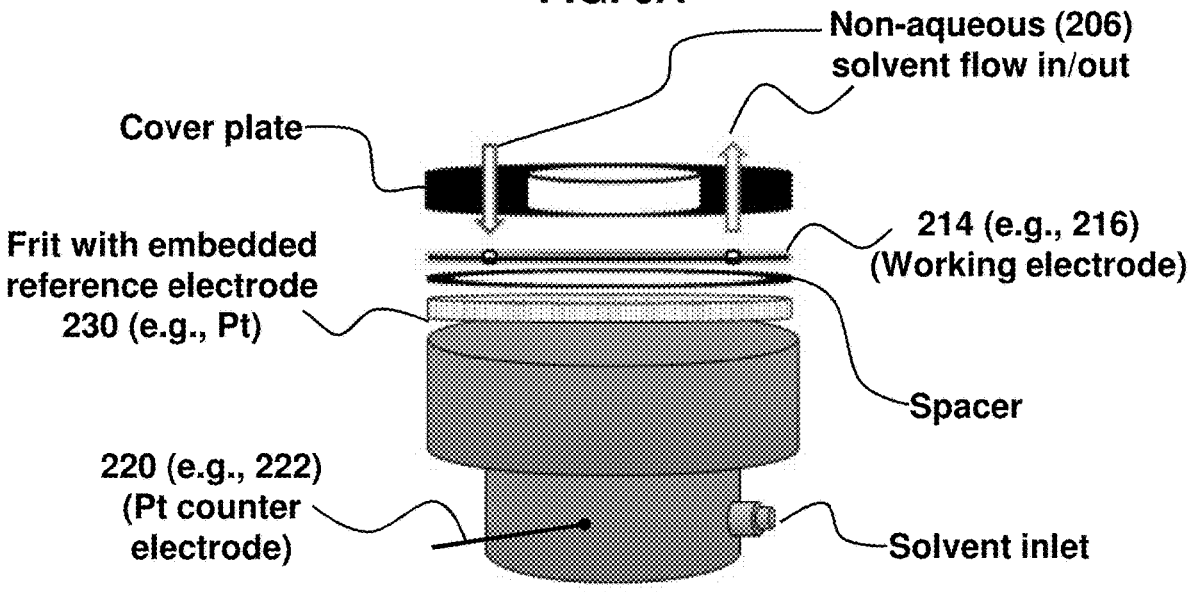

Step 124 is optional. Step 124 may be performed prior to or concurrently with step 104. In step 124, the magnitude of the anodic bias is selected such that the anodic bias of selected magnitude is applied to water oxidation electrocatalyst 200 in step 104. The anodic bias may be selected to activate water oxidation for the desired hydrocarbon reactant and hydrocarbon product. Accordingly, the selectivity of water oxidation electrocatalyst may be intentionally affected by the magnitude of anodic bias selected in step 124. The activity, or reaction rate, of water oxidation electrocatalyst may also be intentionally affected by the magnitude of anodic bias selected in step 124. Therefore, the selection of the anodic bias magnitude in step 124 generates selected or desired hydrocarbon product distribution. For example, the magnitude of the anodic bias may be selected, in step 124, to change the oxidation state of one or more metals in water oxidation electrocatalyst 200, thereby changing the selectivity of the electrocatalyst. For example, water oxidation electrocatalyst 200 is an iron-doped nickel-based layered double hydroxide having the formula $[Ni_{1-x}Fe_x(OH)_2](NO_3)_y(OH)_{x-y}\cdot nH_2O]$, and optionally having additional ions such as $Ti^{4+}$ and/or $La^{3+}$, and the magnitude of the anodic bias is selected to change the oxidation state of between 4+ (e.g., to oxidize toluene to benz-alcohol) and 5+ and/or 6+ (e.g., to oxidize toluene to benzaldehyde); wherein each of x and y independently is a positive number less than 1 (e.g., 0.5 or less) and n is a positive number (e.g., in the range of 0.5 and 4). In some of the embodiments disclosed herein, the magnitude of the anodic bias is greater than or equal to 0.5 V vs. NHE. In some of the embodiments disclosed herein, the magnitude of the anodic bias is selected from the range of 0.5 V to 3.2 V vs. NHE. In some of the embodiments disclosed herein, the magnitude of the anodic bias is selected from the range of 0.5 V to 5 V vs. NHE FIG. 5 is photograph of exemplary flow-through electrocatalysis system components and FIGS. 6A-6B are a photograph and a schematic, respectively, of exemplary assembled flow-through electrocatalysis systems. As described above, panel A of FIG. 5 shows a compartment for counter electrode 220 (e.g., cathode 222). Once the electrocatalysis system is assembled, counter compartment (panel A) is filled with electrolyte solution through a port in the Teflon base. The counter electrode is a platinum wire (seen in panel A) fed through the Teflon base in electrical isolation from the rest of the system. The counter compartment is separated from the working compartment by a Teflon disc fitted with a fine glass frit (panel B). A thin platinum wire is inlaid around the inner diameter of the Teflon disc and leaves the cell through a slot in counter compartment (panel A) that has been coated to be nonconductive. The platinum wire embedded in the frit serves as a reference electrode 230 (optionally, referred to as pseudo-reference electrode), in this example. A thin (ca. 100 μm) Teflon spacer (panel C) is sandwiched between the fine glass frit of panel (B) and the working electrode assembly (panel D), which holds working electrode 214 (e.g., anode 216; e.g., FTO-coated glass) coated with water oxidation electrocatalyst 200. Holes in the working electrode assembly (panel D) line up with the ports in panel E. The threaded ring (panel F) screws on to the counter compartment (panel A) and is tightened to prevent leaking. Gaskets or O-rings between the counter compartment and the fine glass frit (panel (A)/panel (B)) as well as between the working electrode assembly and the port plate (panel (D)/panel (E)) prevent leaking. A predetermined potential is applied and hydrocarbon reactant is pumped into one of the ports in panel (E), either by syringe or by peristaltic pump. In this way, hydrocarbon reactant passes over the electrode without mixing with the electrolyte solution in the counter compartment, below. The high surface area of the electrode combined with the small volume inside the cell increases the current density and yield for a given flow rate. Dashed lines in FIG. 6A represent objects that are inside of the flow-through electrocatalysis system during its operation (e.g., non-aqueous solvent, hydrocarbon reactant, hydrocarbon product, water, and/or supporting electrolyte). FIGS. 5, 6A and 6B illustrate exemplary systems that may be used to perform the hydrocarbon oxidation processes corresponding to FIGS. 1-4, and 7-13

Example 1: Hydrocarbon Oxidation by Water Oxidation Electrocatalysts in Non-Aqueous Solvents Catalytic methods and systems, particularly electrocatalytic methods and systems, for selectively oxidizing hydrocarbon compounds (e.g., reactants 202) using water oxidation electrocatalyst(s) 200 in non-aqueous solvents (e.g., non-aqueous solvent 206) have been discovered. In this example, nickel-based layered double hydroxides (LDHs) doped with iron are shown to be excellent heterogeneous water oxidation electrocatalysts under anodic bias. In this example, hydrocarbon oxidation has been observed in acetonitrile as the non-aqueous solvent. These methods and systems, the first of its kind to utilize a water oxidation electrocatalyst, can be optimized to perform transformations of critical importance to industry, pharmaceuticals, and materials science by selectively activating strong C—H bonds in hydrocarbon reactant(s) 202 to produce useful hydrocarbon product(s) 208 from cheap feedstocks in a sustainable fashion. Other water oxidation electrocatalysts 200 and non-aqueous solvents 206 can be substituted to perform other C—H activations as well as other transformations.

Background and Significance: Layered double hydroxides (LDHs) have been shown to be highly active for water oxidation. We reported a [NiFe]-LDH nanomaterial synthesized by pulsed laser ablation in liquids (PLAL). This material is among the best water oxidation electrocatalysts made of earth abundant elements.[1]

Conventional organic oxidants include potassium permanganate, potassium dichromate, and potassium osmate. The use of these (some highly-toxic) reagents requires delicate control to achieve satisfactory results, limiting their utility in industrial settings. The conventional stoichiometric oxidation of organic hydrocarbon reactants produces excessive amounts of contaminated waste.

Methods and Materials: Exemplary standard oxidation reactions are performed in 0.1 M lithium perchlorate (as example supporting electrolyte 218) in acetonitrile or nitromethane (as example non-aqueous solvent 206) with varying amounts of water 204 (micromolar to millimolar in concentration). The working electrode 214 is prepared by drop-casting 120 μL of a 1 mg/mL suspension of water oxidation electrocatalyst 200 in water onto a fluorine-doped tin oxide (FTO) glass substrate (as example anode 216). A typical three-electrode electrochemical cell is used with a platinum wire counter electrode (as example counter electrode 220, or cathode 222) and a silver/silver ion non-aqueous reference electrode (as example reference electrode 230).

Cyclic voltammetry is performed on blank FTO and electrocatalyst-coated FTO, before and after the addition of hydrocarbon reactant (e.g., 202) at millimolar concentration. Bulk electrolysis (hydrocarbon oxidation) at a constant potential is used to generate hydrocarbon products (e.g., 208), which are detected by NMR (using solvent-suppression techniques) and gas chromatography coupled to mass spectrometry.

Figure 2:
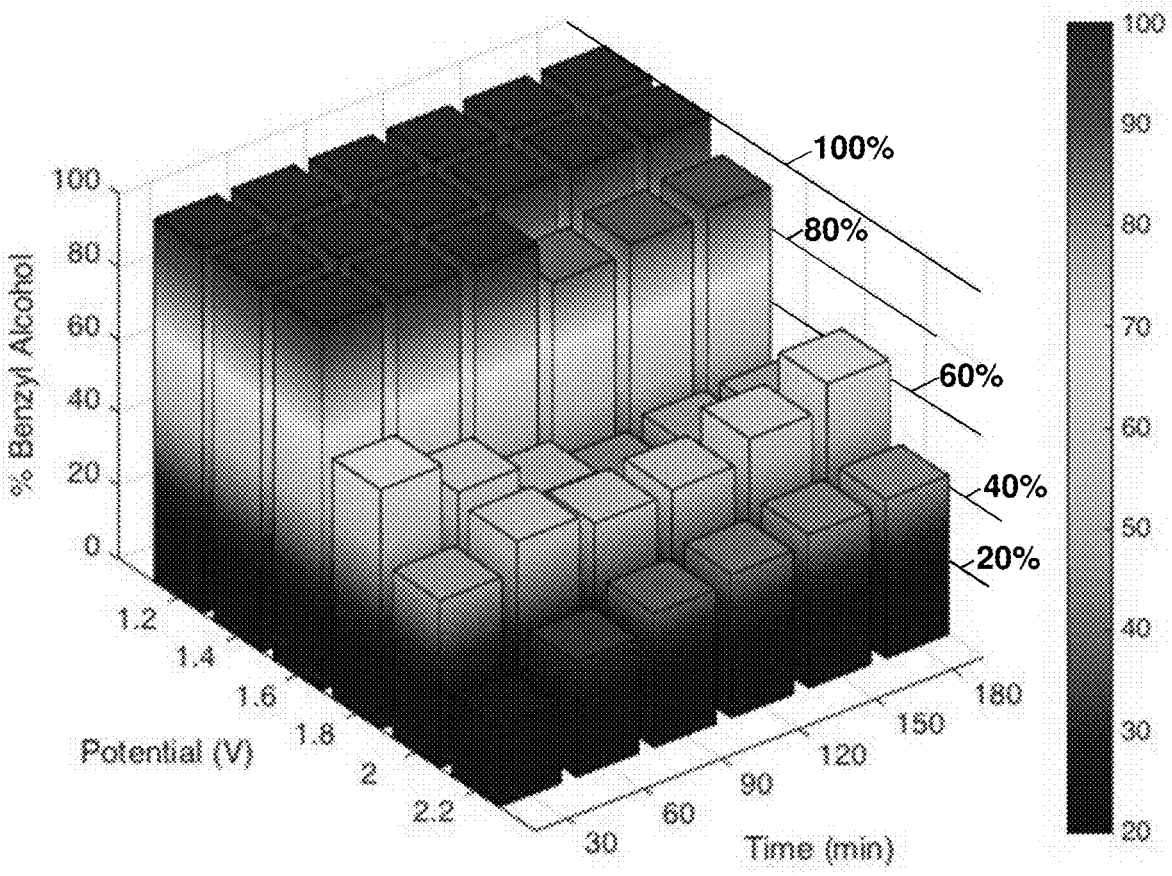
FIG. 2 is a plot of hydrocarbon product distribution (percent (%) of benzyl alcohol relative to total benzyl alcohol and benzaldehyde produced) at various potentials and oxidation process times for an example hydrocarbon oxidation process. The hydrocarbon reactant is toluene, in this example, and the water oxidation electrocatalyst is a nanostructured Ni—Fe layered double hydroxide.

Results: FIG. 2 shows an example hydrocarbon product distribution (% benzyl alcohol relative to total benzyl alcohol and benzaldehyde produced) for hydrocarbon oxidation via [NiFe]-LDH water oxidation electrocatalyst at various magnitudes of anodic bias and oxidation reaction times.

These studies, along with those involving other hydrocarbon reactants 202, can be are to map the hydrocarbon product distribution as a function of anodic bias magnitude and oxidation reaction (electrolysis) time. These "product landscapes" will serve as a roadmap for C—H (hydrocarbon) activation (oxidation) of all types and strengths, with the goal of dialing-in a potential to obtain a desired distribution.

Other factors likely to affect product distribution are reaction (e.g., solvent) temperature, solvent composition (e.g. acetonitrile, nitromethane, etc.), electrocatalyst loading density, and hydrocarbon reactant concentration. At low hydrocarbon reactant concentration, for example, side reactions with solvent molecules have also been observed, leading to alternate hydrocarbon products. These variables allow for further tuning of the system.

Figure 3:
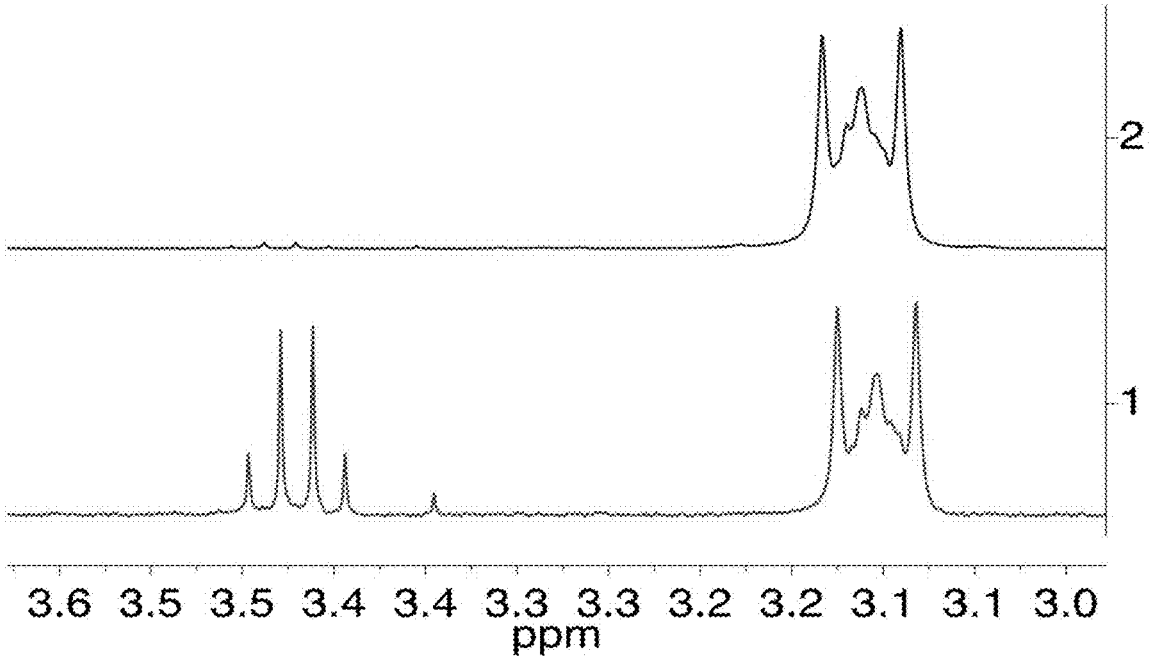
FIG. 3 is NMR (nuclear magnetic resonance) spectra showing cyclohexane after bulk electrolysis (2 hours) without (top) and with (bottom) catalyst at 1.7 V vs. $Ag/Ag^+$ in 0.1 M $LiClO_4$ in acetonitrile. The peak at ~3.45 ppm corresponds to cyclohexanol. Spectra were scaled to the peak at 3.1 ppm, which is present in the electrolyte solution.

Functional Group Tolerance for "Complex" Transformations: Conventional controlled methods to oxidize alkanes at room temperature are very limited and often result in over-oxidation to $CO_2$ and other undesired byproducts. The production of methanol from methane is a case in point. The mild oxidizing conditions employed in the presently disclosed methods and systems can be leveraged to favor selected specific hydrocarbon products (FIG. 3).

The production of allylic alcohols and ketones, important building blocks in the synthesis of organic compounds including pharmaceuticals, represents a significant challenge due to the propensity of the neighboring C=C double bond to undergo epoxidation. In presently disclosed methods and systems, data show that the double bond remains intact during oxidation of certain hydrocarbon reactants (FIG. 4).

Compatibility of the presently disclosed methods, systems, and water oxidation electrocatalysts may extend to hydrocarbon reactants and/or products with other functional groups such as alkynes, alcohols, ethers, epoxides, haloalkanes, aldehydes, acid chlorides, organic acid anhydrides, ketones, esters, carboxylic acids, amides, amines, nitriles, imines, isocyanates, thiols, azos, arenes, and combinations of these.

Flow-through system for rapid conversion: A flow-through electrochemical system has been developed in which the non-aqueous solvent flow rate and anodic bias magnitude are easily controllable. Hydrocarbon reactant(s) enters the anode-containing chamber of the system through one port and product mixtures exit through a secondary port. Details of the system are provided in FIGS. 5 and 6.

Summary: Heterogeneous water oxidation electrocatalysts 200 can be used to electrocatalytically oxidize hydrocarbon reactants 202 in non-aqueous solvents 206 with regioselectivity and extent-of-oxidation selectivity by tuning the anodic bias magnitude and electrolysis (oxidation reaction) time. Functional groups conventionally incompatible with strong oxidants may be preserved in the present systems and methods. A flow-through system is disclosed for enabling bulk transformations.

References: (1) Hunter, B. M.; Blakemore, J. D.; Deimund, M.; Gray, H. B.; Winkler, J. R.; Müller, A. M. *J. Am. Chem. Soc.* 2014, 136, 13118.

Example 2: Oxidation of Diphenylmethane

Experimental: These exemplary experiments are run in wet (0.5% water) acetonitrile with 0.1% (v/v) hydrocarbon reactant with 5 mm width carbon fiber paper (CFP) electrodes unless otherwise noted Two 5 mm wide strips of carbon fiber paper are soaked in isopropanol for 10 seconds and allowed to dry. One is then soaked in a suspension of [NiFe]-LDH nanosheets, as an exemplary water oxidation electrocatalyst, (12 nm diameter) (2 mg of catalyst in 1 mL deionized water) for 15 minutes. The electrodes are dried for 10 minutes under an infrared heat lamp. Electrolysis is performed in a standard three-compartment bulk electrolysis cell, with the counter and reference compartments separated from the working compartment by porous glass frits. Electrolyte solution is 0.1 M $NaClO_4$ in acetonitrile. The electrolysis is run for three hours (25° C.) at a potential of 1.4 V vs a Pt wire pseudo-reference electrode (Gamry Reference 600 Potentiostat). The counter electrode is nickel mesh.

Product analysis is accomplished by GC/MS (Agilent 6890 Series GC coupled to a 5973 Mass Selective Detector) with a 30 meter HP-5MS column and a 14.5 min. run sequence (2 min.@50° C., followed by a 20°/min ramp to 300°). The identities of products are ascertained using authentic standards (Sigma-Aldrich Company) and the NIST Database.

Figure 8A:
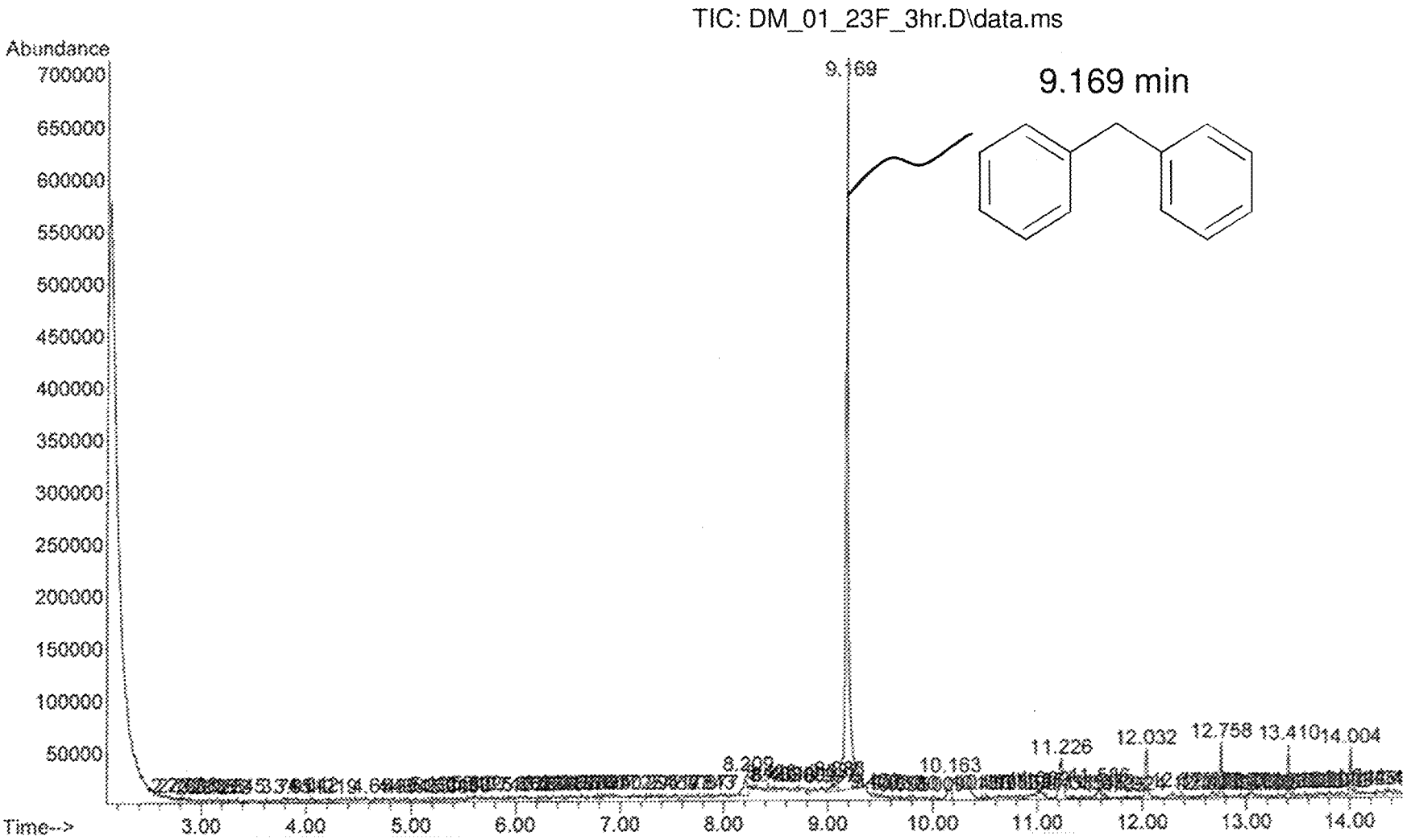
FIG. 8A is a total ion chromatogram (TIC) for a 1 μL injection of cell volume after 3 hour electrolysis without water oxidation electrocatalyst present. The peak at 9.169 min. is the diphenylmethane starting material (hydrocarbon reactant).
Figure 8B:
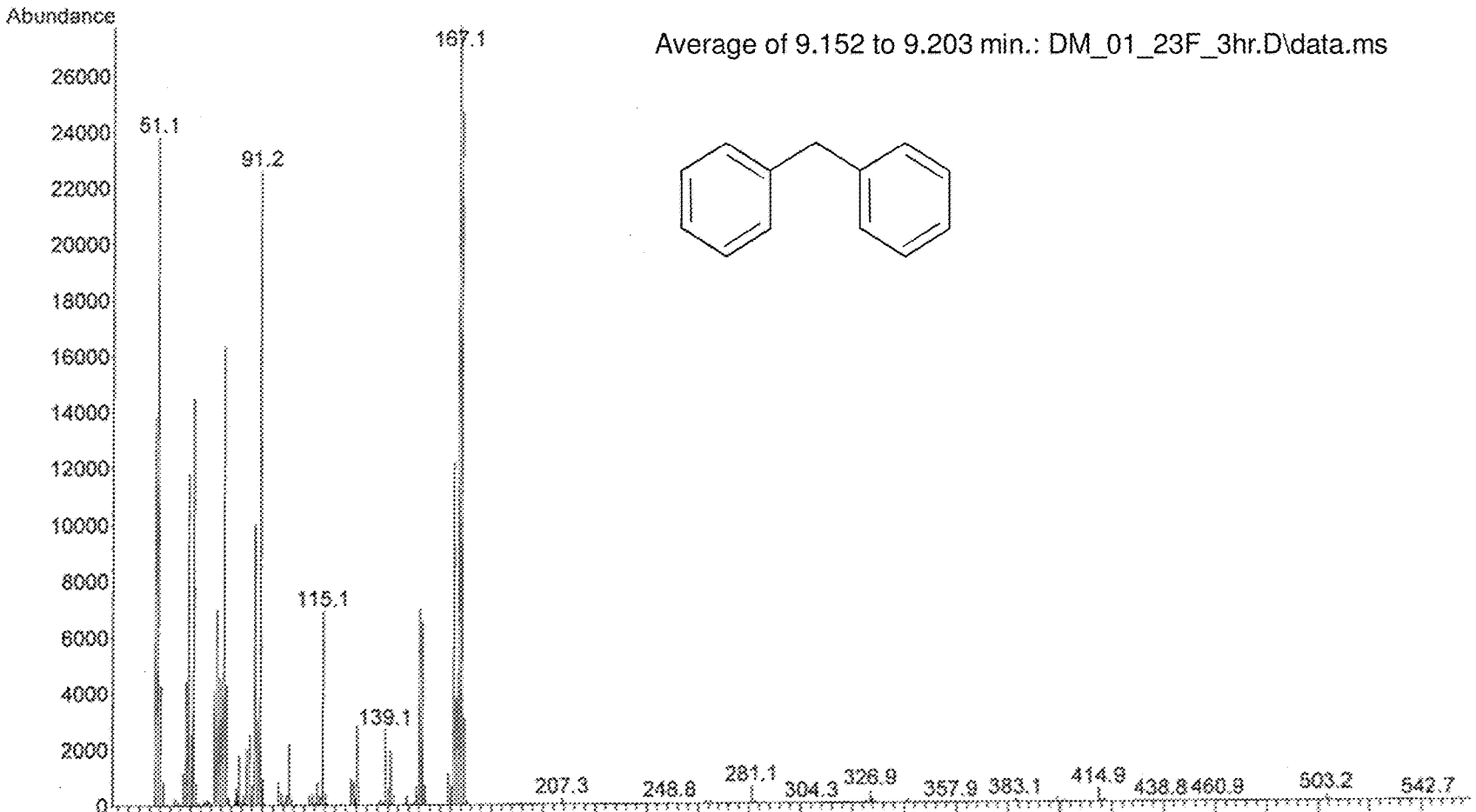
FIG. 8B is an average mass spectrum corresponding to the range of 9.152 min to 9.203 min of the TIC in FIG. 8A. This spectrum matches diphenylmethane in both authentic standard and NIST database.

Results for diphenylmethane oxidation without water oxidation electrocatalyst: FIG. 8A is a total ion chromatogram (TIC) for a 1 μL injection of cell volume after 3 hour electrolysis without water oxidation electrocatalyst present. The peak at 9.169 min. is the diphenylmethane starting material (hydrocarbon reactant). The TIC of FIG. 8A demonstrates that 100% of the detected hydrocarbon is the hydrocarbon reactant (diphenylmethane). FIG. 8B is an average mass spectrum corresponding to the range of 9.152 min to 9.203 min of the TIC in FIG. 8A. This spectrum matches diphenylmethane in both authentic standard and NIST database.

Figure 9A:
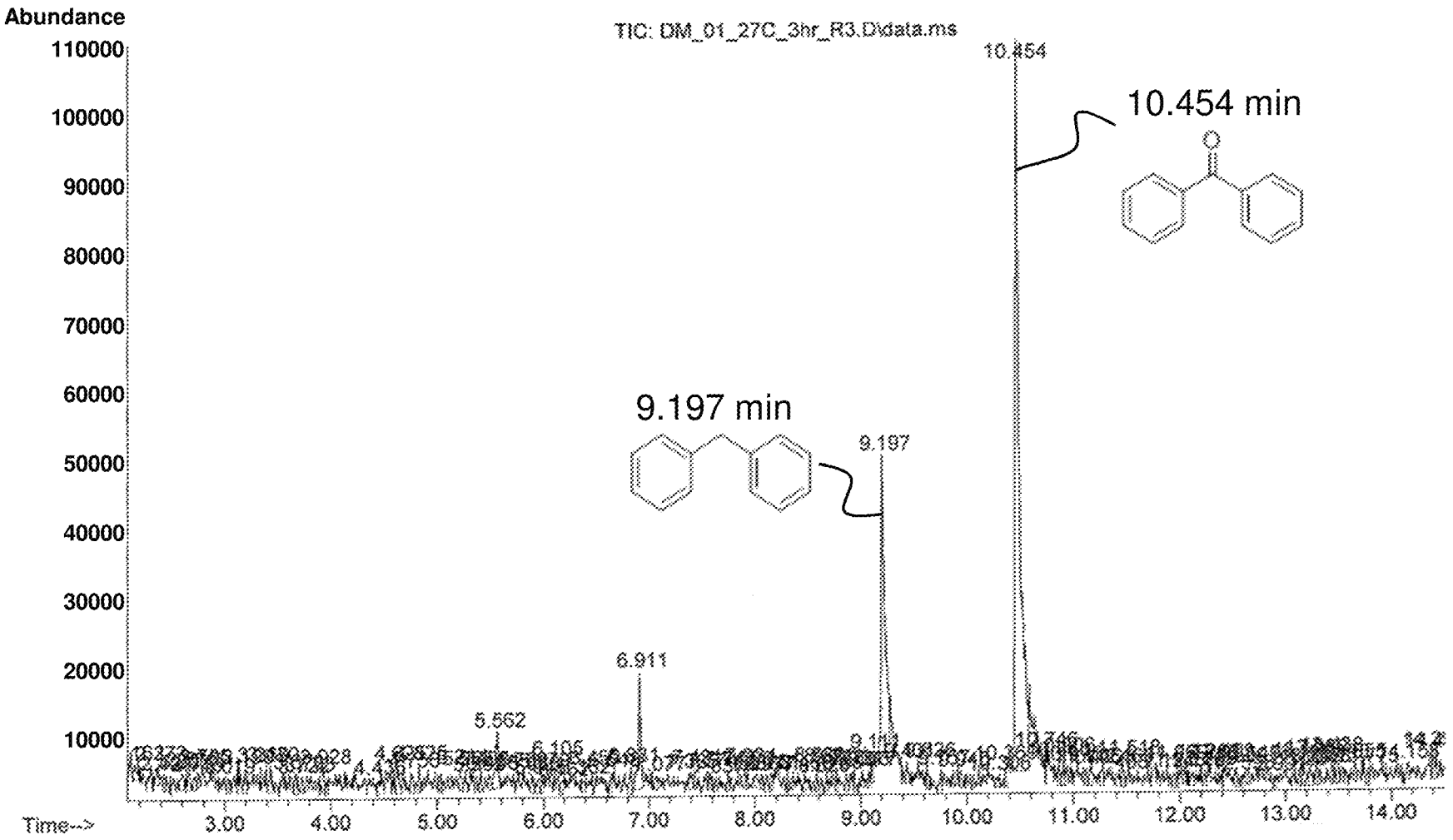
FIG. 9A is a total ion chromatogram (TIC) for a 1 μL injection of cell volume after 3 hour electrolysis with water oxidation electrocatalyst present. The peak at 9.169 min. is the diphenylmethane starting material (hydrocarbon reactant). The peak at 10.454 min. is the benzophenone product (hydrocarbon product). In this example, the use of an exemplary, presently disclosed, water oxidation electrocatalyst leads to approximately 72.1% of the product being benzophenone, an oxidized hydrocarbon, in contrast to the example corresponding to FIGS. 8A-8B (i.e., without water oxidation electrocatalyst). The other peaks represent experimental artifacts corresponding to column bleed.
Figure 9B:
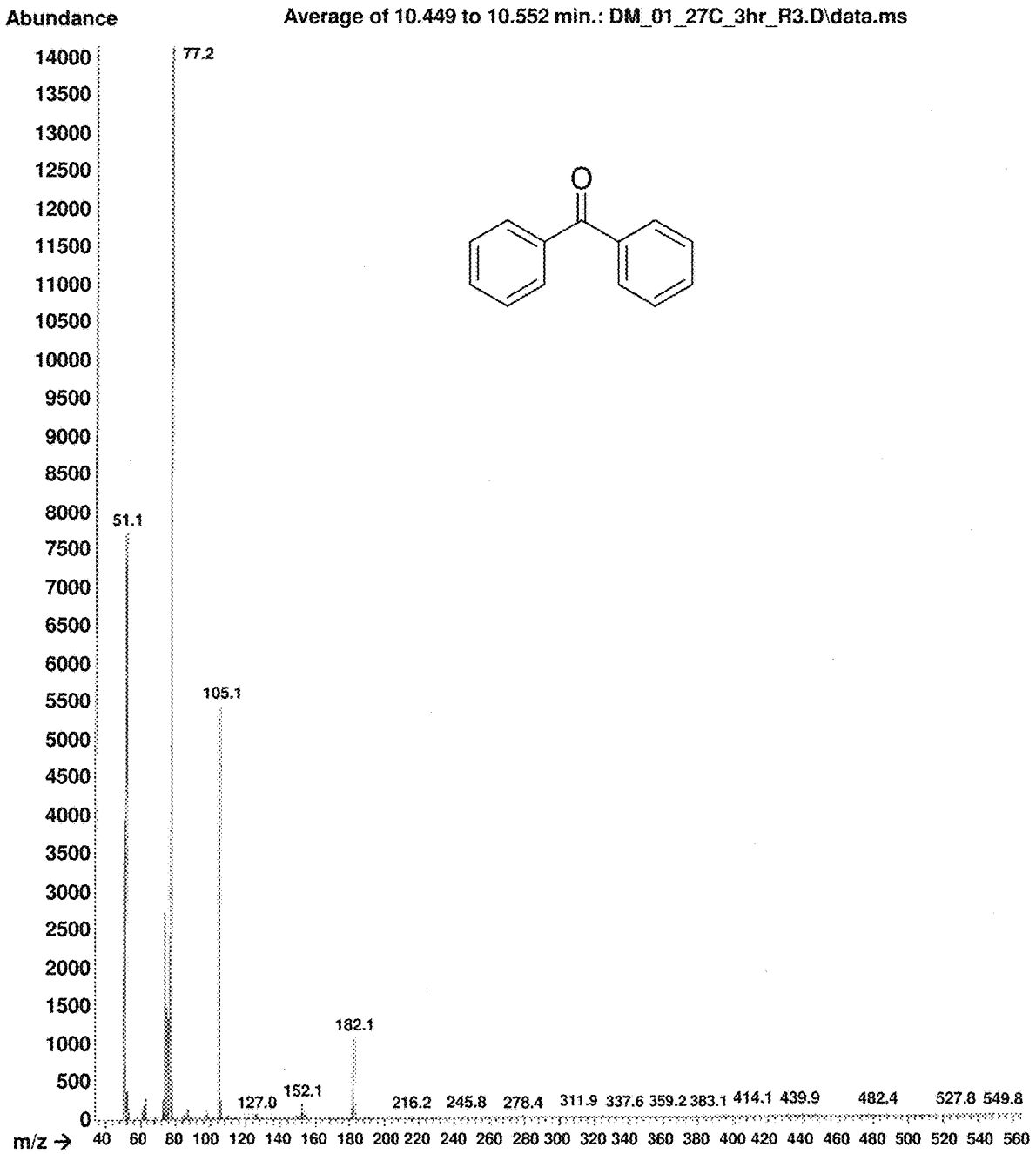
FIG. 9B is an average mass spectrum corresponding to the range of 10.449 min to 10.552 min of the TIC in FIG. 9A. Spectrum matches benzophenone in both authentic standard and NIST database.

Results for diphenylmethane oxidation with water oxidation electrocatalyst: FIG. 9A is a total ion chromatogram (TIC) for a 1 μL injection of cell volume after 3 hour electrolysis with water oxidation electrocatalyst present. The peak at 9.169 min. is the diphenylmethane starting material (hydrocarbon reactant). The peak at 10.454 min. is the benzophenone product (hydrocarbon product). In this example, the use of an exemplary, presently disclosed, water oxidation electrocatalyst (nickel-iron layered double hydroxide) leads to approximately 72.1% of the product solution being benzophenone, an oxidized hydrocarbon, (balance is unoxidized reactant) in contrast to the above experiment corresponding to FIGS. 8A-8B (i.e., without water oxidation electrocatalyst) wherein no oxidized product was detected. These product distribution figures are uncorrected for differential ionization. The other peaks represent experimental artifacts corresponding to column bleed. FIG. 9B is an average mass spectrum corresponding to the range of 10.449 min to 10.552 min of the TIC in FIG. 9A. Spectrum matches benzophenone (the oxidized hydrocarbon product) in both authentic standard and NIST database.

Figure 9C:
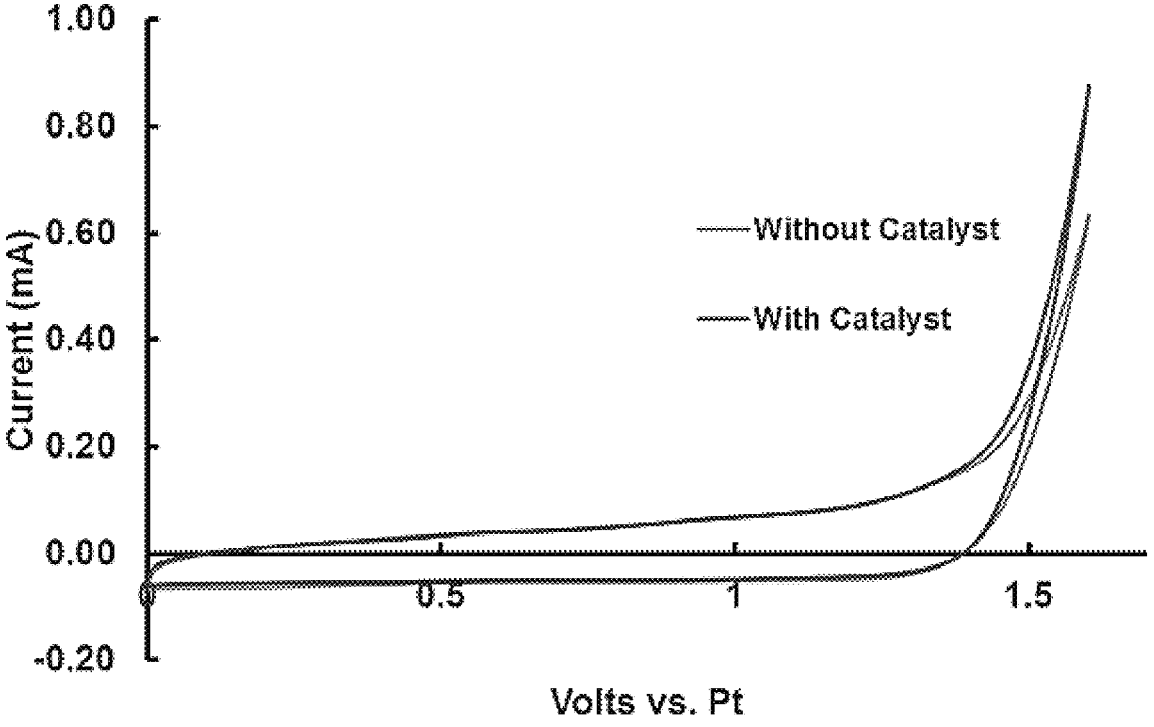
FIG. 9C is a plot of cyclic voltammograms of carbon fiber electrodes with and without water oxidation electrocatalyst in the presence of diphenylmethane hydrocarbon reactant. The presence of water oxidation electrocatalyst showed an increase in oxidative current at anodic potentials higher than ca. 1.5 V vs. a Pt pseudo-reference electrode.

Comparative results for diphenylmethane oxidation with and without water oxidation electrocatalyst: FIG. 9C is a plot of cyclic voltammograms of carbon fiber electrodes with and without water oxidation electrocatalyst in the presence of diphenylmethane hydrocarbon reactant. In each case the area of catalyst exposed to solution was kept constant (0.25 $cm^2$). The presence of water oxidation electrocatalyst showed an increase in oxidative current at anodic potentials higher than ca. 1.5 V vs. a Pt pseudo-reference electrode. In the experiment corresponding to FIG. 9C: the working electrode is 5 mm wide working electrode, prepared as described above; the counter electrode is nickel mesh; the reference electrode is Pt wire; the conditions are 0.1 M $NaClO_4$ in acetonitrile, 25° C.; and the scan rate is 100 mV/s.

Figure 9D:
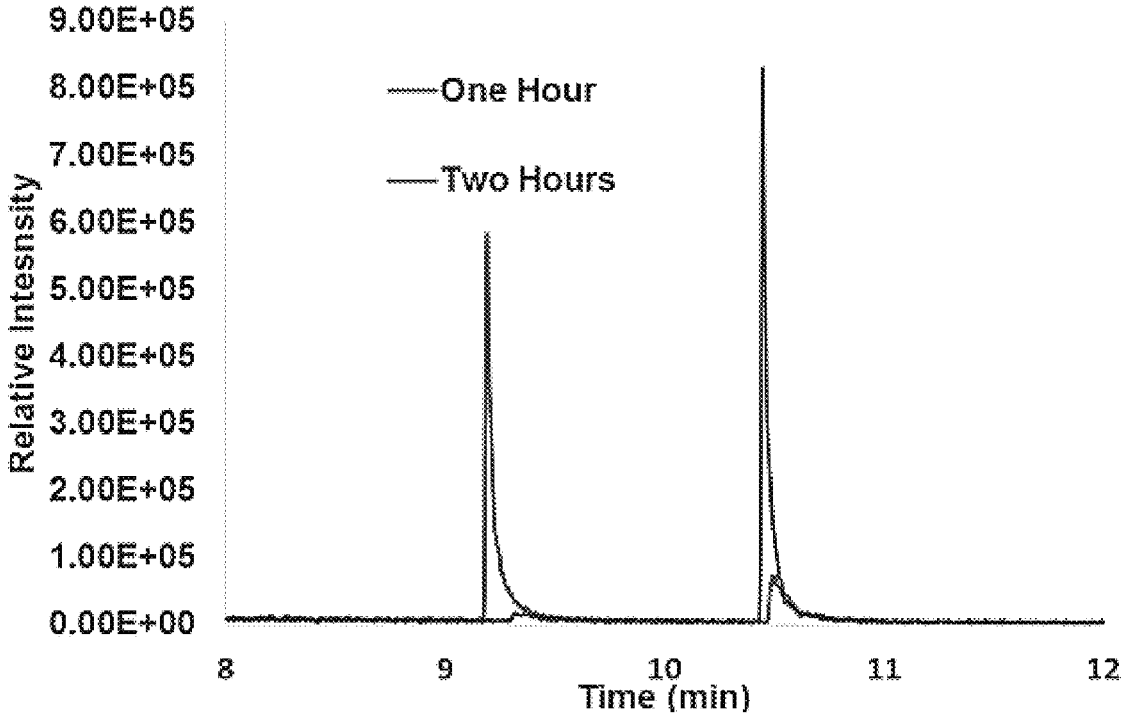
FIG. 9D is a total ion chromatogram (TIC) for 1 μL injections of cell volume after 1 hour and two hours of electrolysis time (i.e., electrocatalysis time; i.e., hydrocarbon oxidation reaction time) with water oxidation electrocatalyst present. The peak at 9.169 min. is diphenylmethane starting material (hydrocarbon reactant). The peak at 10.454 min. is benzophenone product [(oxidized) hydrocarbon product].

Comparative results for diphenylmethane oxidation with water oxidation electrocatalyst for different reaction times (i.e., electrolysis time; i.e., electrocatalysis time; i.e., hydrocarbon oxidation reaction time; e.g., time during which anodic bias is applied to the water oxidation electrocatalyst, directly or indirectly): FIG. 9D is a total ion chromatogram (TIC) for 1 μL injections of cell volume after 1 hour and two hours of electrolysis time with water oxidation electrocatalyst present. The peak at 9.169 min. is diphenylmethane starting material (hydrocarbon reactant). The peak at 10.454 min. is benzophenone product [(oxidized) hydrocarbon product]. These results exemplify the ability to selectively tune the hydrocarbon product distribution (e.g., selectivity and/or activity of water oxidation electrocatalyst) via tuning the oxidation reaction time.

Figure 9E:
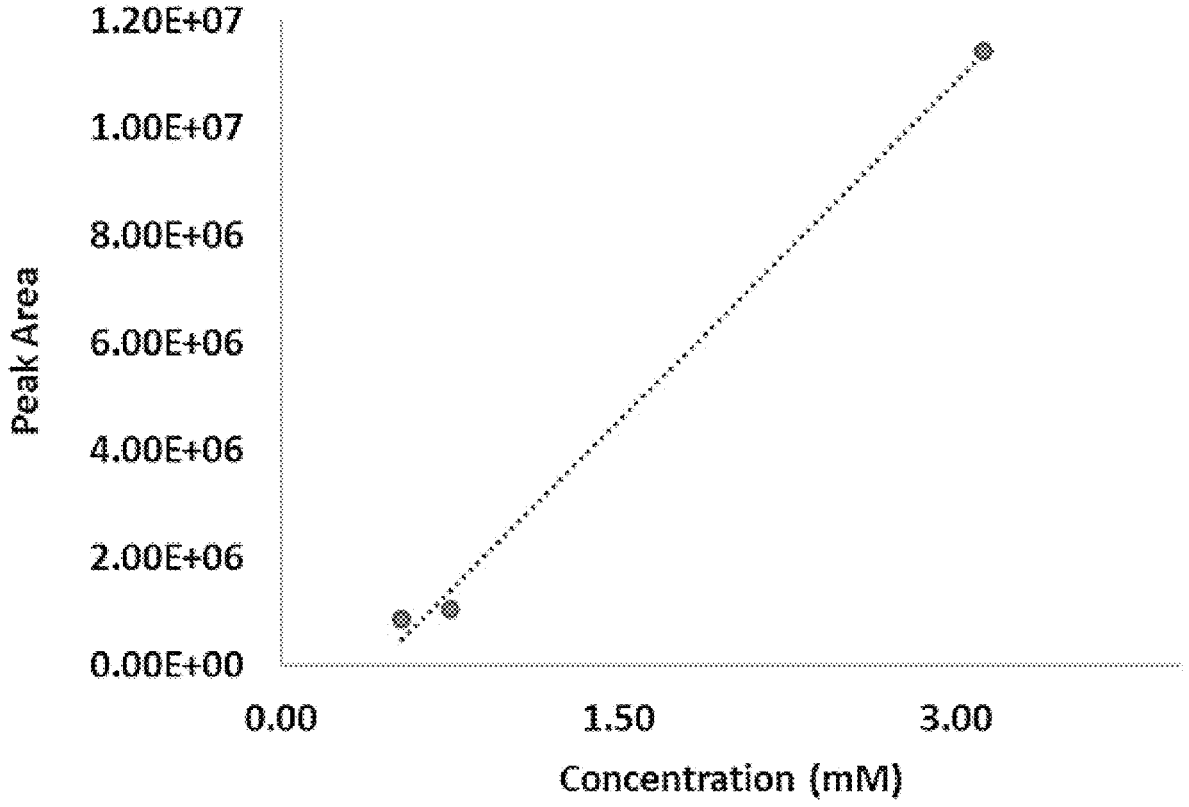
FIG. 9E is a calibration curve for ionization profile of benzophenone on GC/MS, corresponding to exemplary sample calculation to determine the Faradaic efficiency for benzophenone (hydrocarbon product) formation from diphenylmethane (hydrocarbon reactant). Data averaged from three runs.

Calibration details: FIG. 9E is a calibration curve for ionization profile of benzophenone on GC/MS, corresponding to exemplary sample calculation to determine the Faradaic efficiency for benzophenone (hydrocarbon product) formation from diphenylmethane (hydrocarbon reactant). Data is averaged from three runs. An exemplary calculation is as follows:

Average peak area: 317643

Calibration: A=4216831386[C]−1771363

Calculating Moles of Product After 3 Hour Run

Aliquot Concentration: 0.000495 M

Cell Dilution: 10×

Cell Concentration: 0.00495 M

Cell volume (minus aliquot): 0.0048 L

Moles of product in cell: 2.39277E-05 moles Benzophenone

Calculating Electrons Transferred Passed After 3 Hour Run

Charge passed (Corrected for baseline): 9.562 C

Moles of electrons: 9.873E-05 moles $e^-$

Diphenylmethane oxidation is a 4 electron transfer

Efficiency: (2.39277E-05)/(9.873E-05/4)=96.9%

Example 3: Oxidation of (2-chloroethyl)benzene

Experimental: These exemplary experiments are run in wet (0.5% water) acetonitrile with 0.1% (v/v) hydrocarbon reactant with 5 mm width CFP electrodes unless otherwise noted. A 5 mm wide strip of carbon fiber paper is soaked in isopropanol for 10 seconds and allowed to dry. The electrode is then soaked in a solution of [NiFe]-LDH nanosheets (12 nm diameter) (2 mg of catalyst in 1 mL deionized water) for 15 minutes. The electrode is dried for 10 minutes under an infrared heat lamp. Electrolysis is performed in a standard three-compartment bulk electrolysis cell, with the counter and reference compartments separated from the working compartment by porous glass frits. Electrolyte solution is 0.1 M $NaClO_4$ in acetonitrile. The electrolysis is run for twelve hours (25° C.) at a potential of 1.6 V vs a Pt wire pseudo-reference (Princeton Applied Research Model 173 Potentiostat with MATLAB Controller). The counter electrode is platinum wire.

Product analysis is accomplished by GC/MS (Agilent 6890 Series GC coupled to a 5973 Mass Selective Detector) with a 30 meter HP-5MS column and a 29.5 minute run sequence (2 min.@50° C., followed by a 20°/min ramp to 300° C. and a 15 min. hold at 300° C.). The identity of the main product is ascertained using the NIST Database.

Figure 10A:
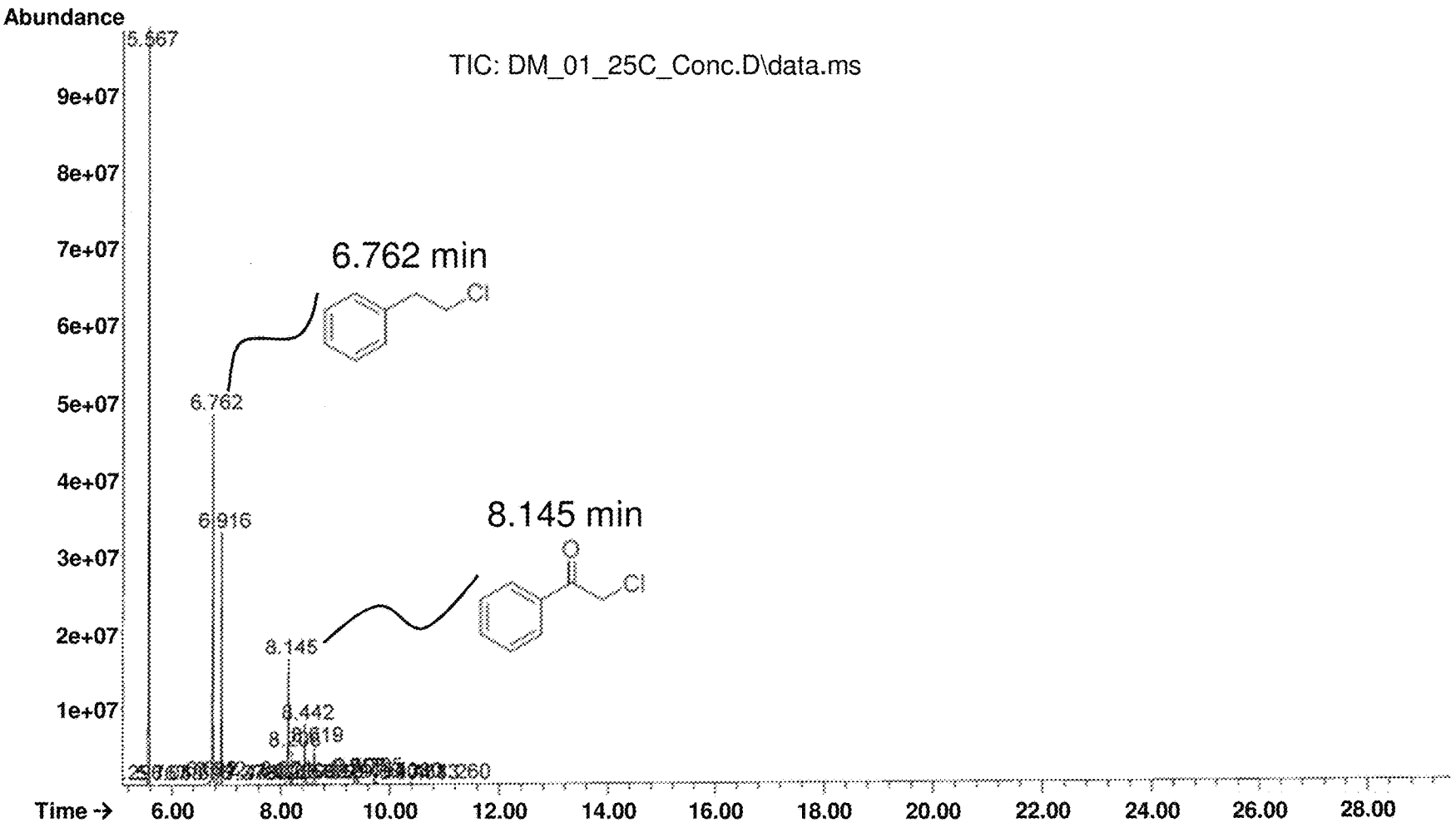
FIG. 10A is a total ion chromatogram (TIC) for a 1 μL injection of cell volume after 12 hour electrolysis (i.e., electrocatalysis time; i.e., hydrocarbon oxidation reaction time) with water oxidation electrocatalyst present. The peak at 6.762 min. is (2-chloroethyl)benzene starting material (hydrocarbon reactant). The peak at 8.145 min. is the ketone product [(oxidized) hydrocarbon product]. The other peaks are siloxanes due to column bleed.
Figure 10B:
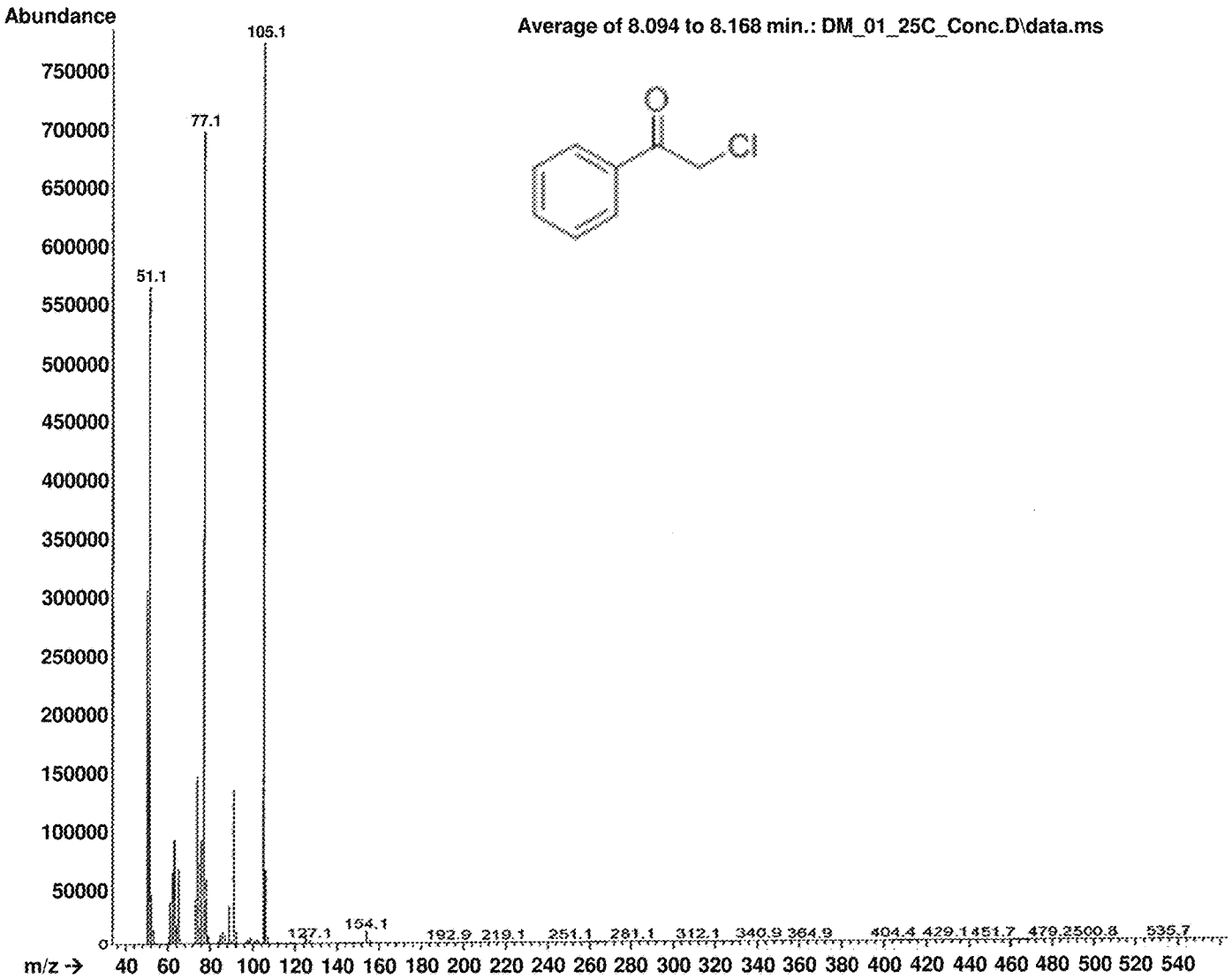
FIG. 10B is an average mass spectrum corresponding to the range of 8.094 min to 8.168 min of the TIC in FIG. 10A.

Results: FIG. 10A is a total ion chromatogram (TIC) for a 1 μL injection of cell volume after 12 hour electrolysis (i.e., electrocatalysis time; i.e., hydrocarbon oxidation reaction time) with water oxidation electrocatalyst present. The peak at 6.762 min. is (2-chloroethyl)benzene starting material (hydrocarbon reactant). The peak at 8.145 min. is the ketone product [(oxidized) hydrocarbon product]. The other peaks are siloxanes due to column bleed. This TIC corresponds to the product solution having approximately 25.5% of oxidized hydrocarbon product (phenacyl chloride; otherwise referred to as 2-chloroacetophenone; otherwise referred to as 2-chloro-1-phenylethanone) and approximately 74.5% unoxidized reactant ((2-chloroethyl)benzene; otherwise referred to as 2-phenylethyl chloride), under these exemplary experimental parameters. These product distribution figures are uncorrected for differential ionization. FIG. 10B is an average mass spectrum corresponding to the range of 8.094 min to 8.168 min of the TIC in FIG. 10A. These demonstrations of 2-chloroethyl)benzene oxidation to form phenacyl chloride are examples of the ability of certain presently disclosed processes, and particularly the certain presently disclosed water oxidation electrocatalysts, to keep a neighboring C=C double bond intact while successfully oxidizing a C—H bond to form a ketone, an exemplary important building block for certain industries.

Example 4: Oxidation of methyl (5-methoxy)salicylate

Experimental: These exemplary experiments are run in wet (0.5% water) acetonitrile with 0.1% (v/v) hydrocarbon reactant with 5 mm width CFP electrodes unless otherwise noted. A 5 mm wide strip of carbon fiber paper is soaked in isopropanol for 10 seconds and allowed to dry. The electrode is then soaked in a solution of [NiFe]-LDH nanosheets (12 nm diameter) (2 mg of catalyst in 1 mL deionized water) for 15 minutes. The electrode is dried for 10 minutes under an infrared heat lamp. Electrolysis is performed in a standard three-compartment bulk electrolysis cell, with the counter and reference compartments separated from the working compartment by porous glass frits. Electrolyte solution is 0.1 M $NaClO_4$ in acetonitrile. The electrolysis is run for three hours (25° C.) at a potential of 1.2 V vs a Pt wire pseudo-reference (CH Instruments Model 660 Potentiostat). The counter electrode is nickel mesh.

Product analysis is accomplished by GC/MS (Agilent 6890 Series GC coupled to a 5973 Mass Selective Detector) with a 30 meter HP-5MS column and a 29.5 min. run sequence (2 min. @ 50° C., followed by a 20°/min ramp to 300° C. and a 15 min. hold at 300° C.). The identity of the main product is ascertained using the NIST Database.

Figure 11A:
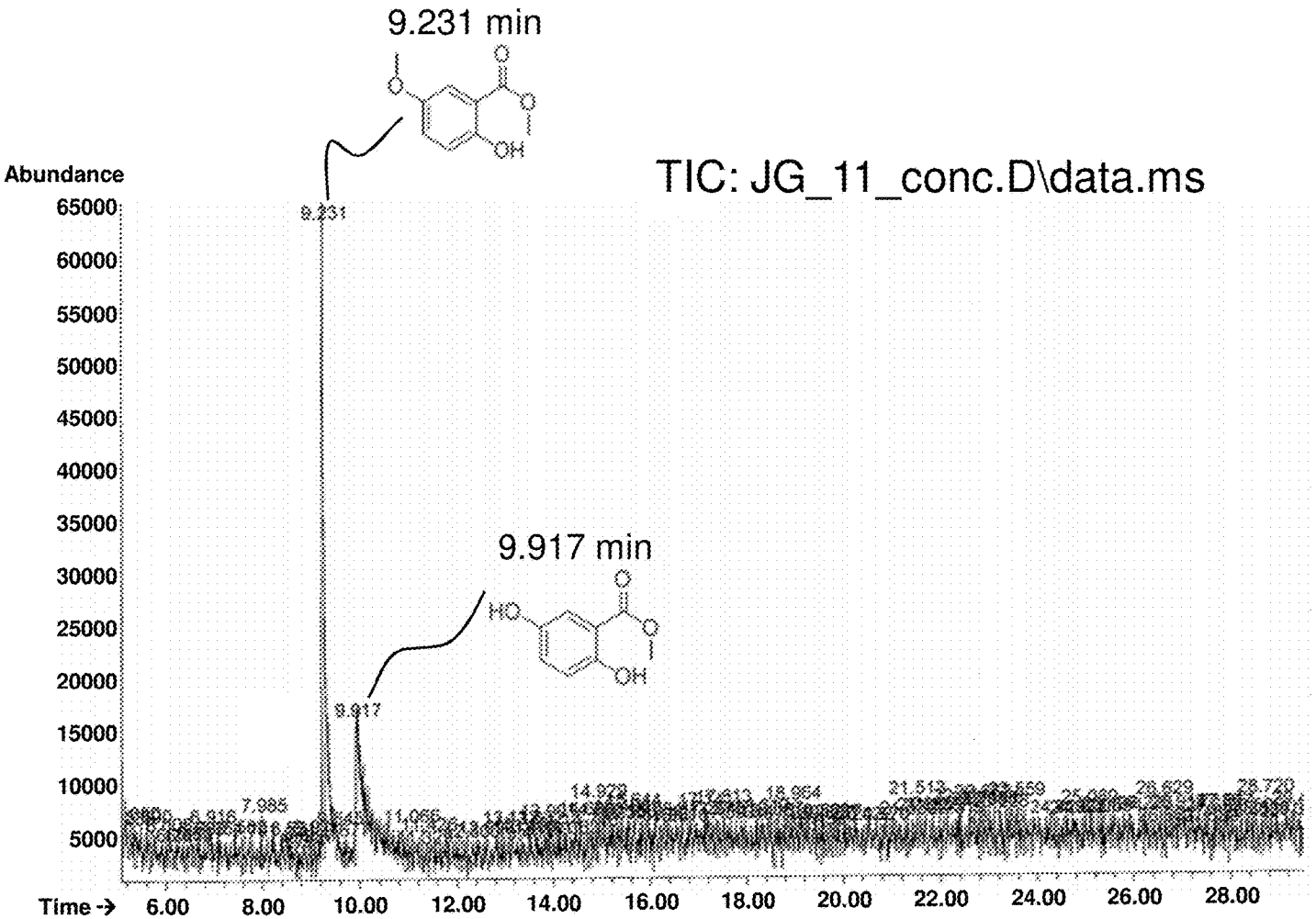
FIG. 11A is a total ion chromatogram (TIC) for a 1 μL injection of cell volume after 3 hour electrolysis (i.e., electrocatalysis time; i.e., hydrocarbon oxidation reaction time) with water oxidation electrocatalyst present. The peak at 9.231 min. is methyl (5-methoxy)salicylate starting material (hydrocarbon reactant). The peak at 9.917 min. is the alcohol product [(oxidized) hydrocarbon product].
Figure 11B:
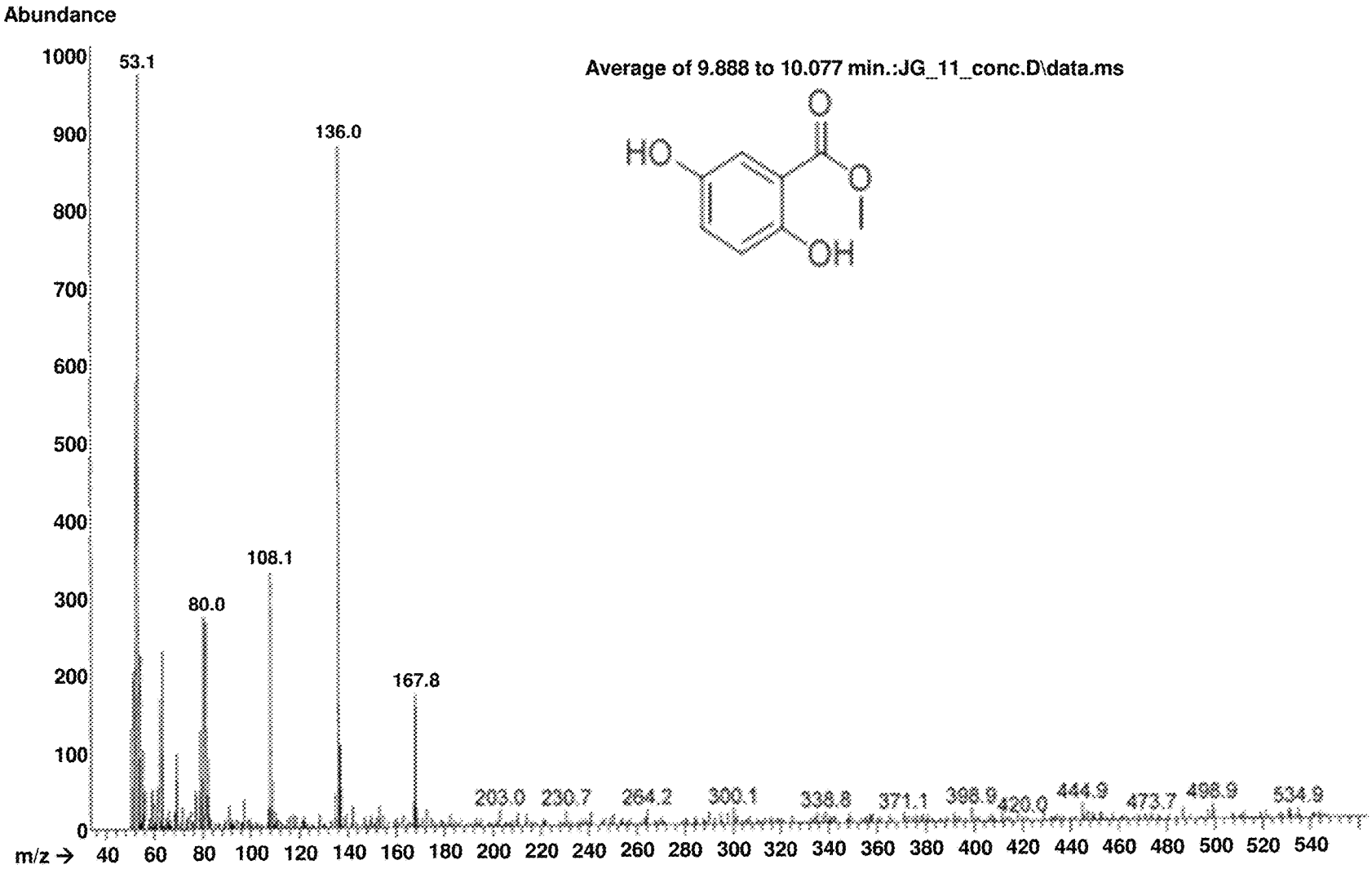
FIG. 11B is an average mass spectrum corresponding to the range of 9.888 to 10.077 min of the TIC in FIG. 11A. This spectrum matches NIST database for Benzoic acid, 2,5-dihydroxy-, methyl ester [the (oxidized) hydrocarbon product].

Results after 3 hours of electrolysis at 1.2 V vs Pt with catalyst coated CFP: FIG. 11A is a total ion chromatogram (TIC) for a 1 μL injection of cell volume after 3 hour electrolysis (i.e., electrocatalysis time; i.e., hydrocarbon oxidation reaction time) with water oxidation electrocatalyst present. The peak at 9.231 min. is methyl (5-methoxy) salicylate starting material (hydrocarbon reactant). The peak at 9.917 min. is the alcohol product [(oxidized) hydrocarbon product]. This TIC corresponds to the product solution having approximately 11.3% of oxidized product (methyl 2,5-dihydroxybenzoate; otherwise referred to as methyl gentisate; otherwise referred to as benzoic acid, 2,5-dihydroxy-, methyl ester) and approximately 88.7% unoxidized reactant (methyl (5-methoxy)salicylate), under these exemplary experimental parameters. These product distribution figures are uncorrected for differential ionization. FIG. 11B is an average mass spectrum corresponding to the range of 9.888 to 10.077 min of the TIC in FIG. 11A. This spectrum matches NIST database for benzoic acid, 2,5-dihydroxy-, methyl ester [i.e., the (oxidized) hydrocarbon product].

Example 5: Oxidation of Cyclohexene

Experimental: These exemplary experiments are run in wet (0.5% water) acetonitrile with 0.1% (v/v) hydrocarbon reactant with 5 mm width CFP electrodes unless otherwise noted. 100 μL of a solution of [NiFe]-LDH nanosheets (12 nm diameter) (2 mg of catalyst in 1 mL deionized water) is drop cast on a 5 mm wide strip of fluorine-doped tin oxide glass (FTO). The electrode is dried for 10 minutes under an infrared heat lamp. Electrolysis is performed in a standard three-compartment bulk electrolysis cell, with the counter and reference compartments separated from the working compartment by porous glass frits. Electrolyte solution was 0.1 M $LiClO_4$ in acetonitrile. The electrolysis is run for two hours (25° C.) at a potential of 1.8 V vs a Ag wire in 0.1 M $AgNO_3$ and 0.1 M $LiClO_4$ in acetonitrile ($Ag^+/Ag$) (Gamry Reference 600 Potentiostat). The counter electrode is a platinum wire.

Product analysis is accomplished by NMR in 50% deuterated acetonitrile (400 MHz Bruker with automation) using a multi-solvent suppression pulse sequence.

Figure 12A:
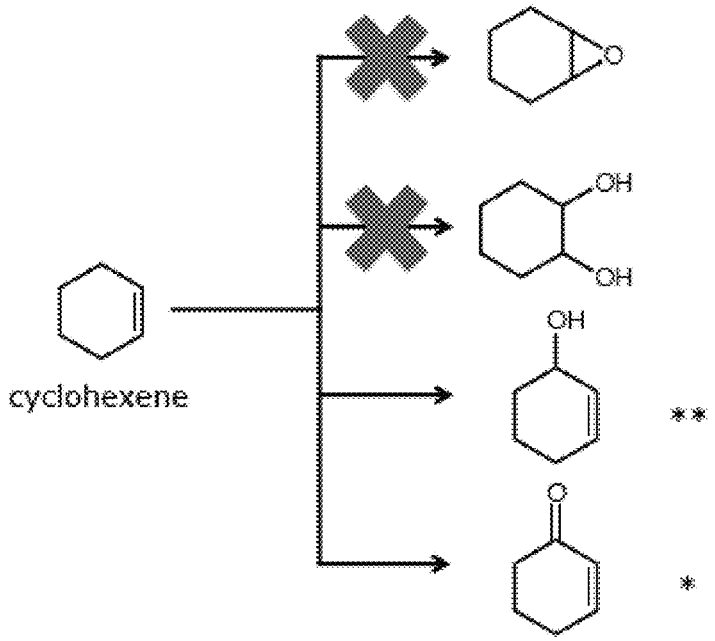
FIG. 12A is a schematic illustrating that of four possible hydrocarbon products of cyclohexene oxidation using an exemplary water oxidation electrocatalyst (NiFe-LDH in this example), two products are observed and two products are not observed, highlighting the selectivity of the exemplary water oxidation electrocatalyst and the exemplary process.
Figure 12B:
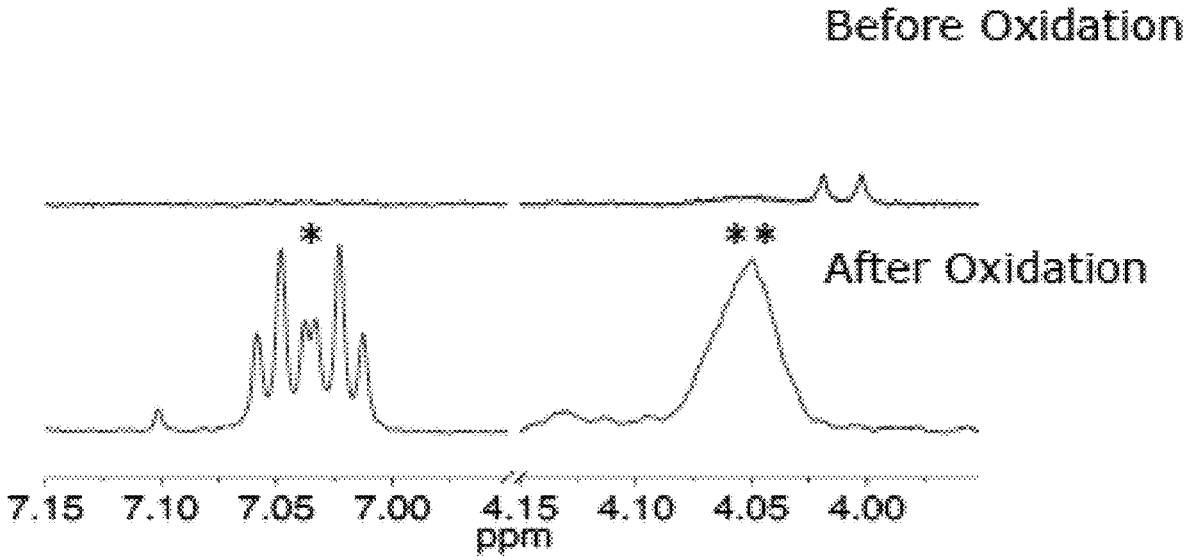
FIG. 12B is a plot of NMR specta corresponding to the solution before hydrocarbon oxidation (top) and the solution after hydrocarbon oxidation (bottom). These NMR spectra are collected after 2 hours of electrolysis (i.e., electrocatalysis time; i.e., hydrocarbon oxidation reaction time). The signal at ca. 7.03 ppm is due to cyclohexenone, while the signal at 4.05 ppm is due to cyclohexenol. Samples are taken in 50% deutero/50% proteo acetonitrile mixture with multi-solvent suppression pulse sequence.

Results: FIG. 12A is a schematic illustrating that of four possible hydrocarbon products of cyclohexene oxidation using an exemplary water oxidation electrocatalyst (NiFe-LDH in this example), two products are observed and two products are not observed, for the present exemplary reaction conditions, highlighting the selectivity of the exemplary water oxidation electrocatalyst and the exemplary process. FIG. 12B is a plot of NMR specta corresponding to the solution before hydrocarbon oxidation (top) and the solution after hydrocarbon oxidation (bottom). These NMR spectra are collected after 2 hours of electrolysis (i.e., electrocatalysis time; i.e., hydrocarbon oxidation reaction time). The signal at ca. 7.03 ppm is due to cyclohexenone, while the signal at 4.05 ppm is due to cyclohexenol (i.e., the oxidized product). Samples are taken in 50% deutero/50% proteo acetonitrile mixture with multi-solvent suppression pulse sequence. FIG. 4 also demonstrates NMR spectra before (top) and after (bottom) oxidation of cyclohexene using an embodiment of the processes and systems disclosed herein. These demonstrations of cyclohexene oxidation to form cyclohexenol are examples of the ability of certain presently disclosed processes, and particularly the certain presently disclosed water oxidation electrocatalysts, to keep a neighboring C=C double bond intact while successfully oxidizing a C—H bond.

Example 6: Oxidation of Toluene

Experimental: These exemplary experiments are run in wet (0.5% water) acetonitrile with 0.1% (v/v) hydrocarbon reactant with 5 mm width CFP electrodes unless otherwise noted. 100 μL of a solution of [NiFe]-LDH nanosheets (12 nm diameter) (2 mg of catalyst in 1 mL deionized water) is drop cast on a 5 mm wide strip of fluorine-doped tin oxide glass (FTO). The electrode is dried for 10 minutes under an infrared heat lamp. Electrolysis is performed in a standard three-compartment bulk electrolysis cell, with the counter and reference compartments separated from the working compartment by porous glass frits. Electrolyte solution is 0.1 M $LiClO_4$ in acetonitrile. The electrolysis is run for two hours (25° C.) at a potential of 1.8 V vs a Ag wire in 0.1 M $AgNO_3$ and 0.1 M $LiClO_4$ in acetonitrile ($Ag^+/Ag$) (Gamry Reference 600 Potentiostat). The counter electrode is a platinum wire.

Product analysis is accomplished by NMR in 50% deuterated acetonitrile (400 MHz Bruker with automation) using a multi-solvent suppression pulse sequence.

Figure 13:
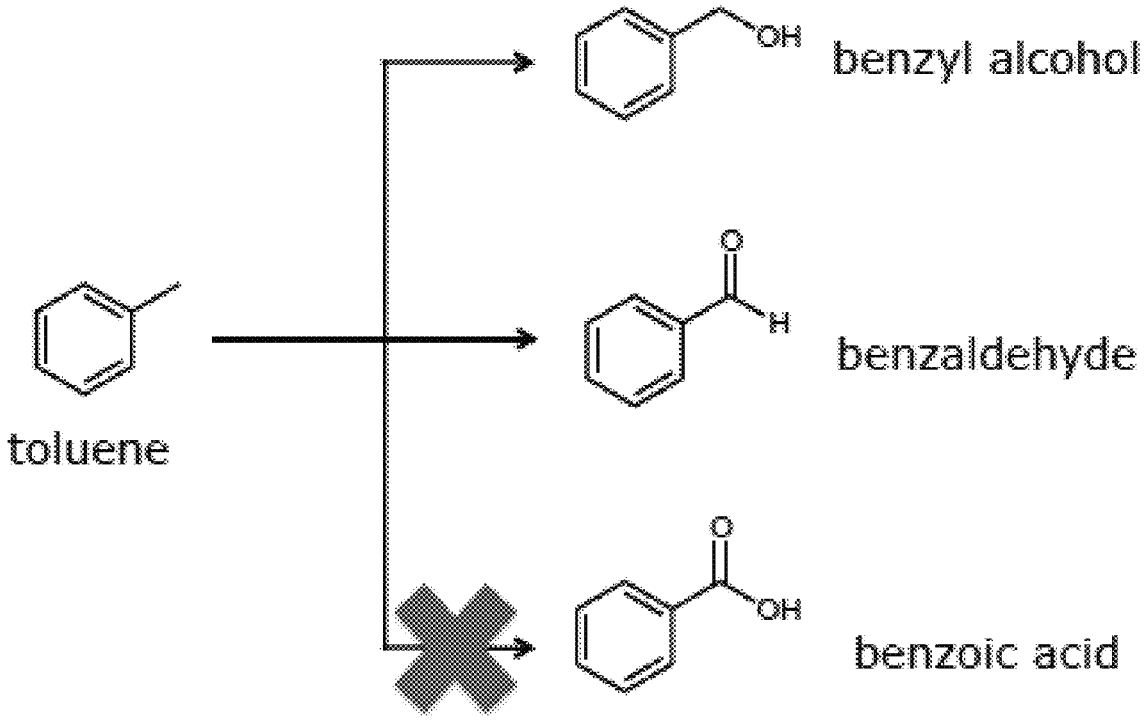
FIG. 13 is a schematic illustrating that of three possible hydrocarbon products of toluene oxidation using an exemplary water oxidation electrocatalyst (NiFe-LDH in this example), two products are observed and one products is not observed, highlighting the selectivity of the exemplary water oxidation electrocatalyst and the exemplary process. For example, this schematic may correspond to the experimental data represented by FIG. 2.

Results: FIG. 13 is a schematic illustrating that of three possible hydrocarbon products of toluene oxidation using an exemplary water oxidation electrocatalyst (NiFe-LDH in this example), two products are observed and one product is not observed, under the present exemplary reaction conditions, highlighting the selectivity of the exemplary water oxidation electrocatalyst and the exemplary process. For example, this schematic may correspond to the experimental data represented by FIG. 2. For example, toluene oxidation by an exemplary oxidation processes disclosed herein yields selected distributions of benzyl alcohol and benzaldehyde (optionally with some unoxidized reactant remaining) without yielding benzoic acid. For example, the plot of FIG. 2 corresponds to percent benzyl alcohol (as a percent of total benzyl alcohol and benzaldehyde production) as a function of electrolysis potential (vs. $Ag^+/Ag$) and electrolysis time at 25° C. for 100-120 μL solution of [NiFe]-LDH catalyst drop cast on a 5 mm strip of FTO glass substrate. FIGS. 6A and 6B illustrate exemplary systems that may be used to perform the hydrocarbon oxidation processes corresponding to FIGS. 1-4, and 7-13.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the systems, system components, methods steps set forth in the present description. As will be obvious to one of skill in the art, methods and systems useful for the present methods can include a large number of optional composition and processing elements and steps.

When a group of substituents is disclosed herein, it is understood that all individual members of that group and all subgroups, including any isomers, enantiomers, and diastereomers of the group members, are disclosed separately. When a Markush group or other grouping is used herein, all individual members of the group and all combinations and subcombinations possible of the group are intended to be individually included in the disclosure. When a compound is described herein such that a particular isomer, enantiomer or diastereomer of the compound is not specified, for example, in a formula or in a chemical name, that description is intended to include each isomers and enantiomer of the compound described individual or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently.

It must be noted that as used herein and in the appended claims, the singular forms "a", "an", and "the" include plural reference unless the context clearly dictates otherwise. Thus, for example, reference to "a cell" includes a plurality of such cells and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and In an embodiment is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are now described. Nothing herein is to be construed as an admission that the invention is not entitled to antedate such disclosure by virtue of prior invention.

Every formulation or combination of components described or exemplified herein can be used to practice the invention, unless otherwise stated.

Whenever a range is given in the specification, for example, a temperature range, a time range, or a composition or concentration range, all intermediate ranges and subranges, as well as all individual values included in the ranges given are intended to be included in the disclosure. As used herein, ranges specifically include the values provided as endpoint values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, reagents, synthetic methods, analytical methods, assay methods, and other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

We claim:

1. A process for oxidation of a hydrocarbon reactant to generate an oxidized hydrocarbon product, said process comprising:

contacting a water oxidation electrocatalyst with said hydrocarbon reactant and water in the presence of a non-aqueous solvent; wherein said hydrocarbon reactant and said water are dissolved in said non-aqueous solvent;

selecting an anodic bias to change the oxidation state of one or more metal ions in the water oxidation electrocatalyst; and applying the anodic bias to said water oxidation electrocatalyst, thereby generating said oxidized hydrocarbon product;

wherein the applied anodic bias comprises anodic bias greater than 1.5 V vs. a Pt pseudo-reference electrode;

wherein said oxidized hydrocarbon product is dissolved in said non-aqueous solvent;

wherein said water oxidation electrocatalyst comprises one or more transition metals other than Ru; wherein said water oxidation electrocatalyst is a nanostructured layered double hydroxide solid, a perovskite, a polyoxometalate, a metal oxide, or a metal-organic framework; and wherein said water is provided in said non-aqueous solvent at a concentration less than or equal to 1 vol. %.

2. The process of claim 1, wherein said water is provided in said non-aqueous solvent at a concentration less than or equal to 0.5 vol. %.

3. The process of claim 1, wherein a magnitude of said anodic bias is selected to generate said oxidized hydrocarbon product characterized by a selected product distribution.

4. The process of claim 1, wherein said water oxidation electrocatalyst does not comprise Ru.

5. The process of claim 1, wherein said water oxidation electrocatalyst is an inorganic catalyst.

6. The process of claim 1, wherein said water oxidation electrocatalyst further comprises one or more earth abundant metals.

7. The process of claim 1, wherein said water oxidation electrocatalyst is the nanostructured layered double hydroxide solid, the perovskite, the polyoxometalate, or the metal-organic framework.

8. The process of claim 1, wherein said water oxidation electrocatalyst is not an organometallic catalyst.

9. The process of claim 1, wherein said water oxidation electrocatalyst is a heterogeneous catalyst.

10. The process of claim 1, wherein said water oxidation electrocatalyst is provided in the form of nanoparticles.

11. The process of claim 1, wherein said hydrocarbon reactant comprises a substituted or unsubstituted: $C_1$-$C_{10}$ alkyl, $C_3$-$C_{10}$ cycloalkyl, $C_5$-$C_{10}$ aryl, $C_5$-$C_{10}$ heteroaryl, $C_1$-$C_{10}$ acyl, $C_1$-$C_{10}$ hydroxyl, $C_1$-$C_{10}$ alkoxy, $C_2$-$C_{10}$ alkenyl, $C_2$-$C_{10}$ alkynyl, $C_5$-$C_{10}$ alkylaryl, $C_3$-$C_{10}$ arylene, $C_3$-$C_{10}$ heteroarylene, $C_2$-$C_{10}$ alkenylene, $C_3$-$C_{10}$ cylcoalkenylene, $C_2$-$C_{10}$ alkynylene, ammonium ion, or any combination thereof.

12. The process of claim 11, wherein said hydrocarbon reactant comprises a phosphate ion, a hexafluorophosphate ion, an amine, an imine, a carbonyl, an ether, a nitrile, or a combination of these functional groups.

13. The process of claim 1, wherein said oxidized hydrocarbon product comprises an alcohol, an ether, an epoxide, a ketone, a carboxylic acid, an aldehyde, an acid chloride, an organic acid anhydride, or a combination thereof.

14. The process of claim 13, wherein said oxidized hydrocarbon product comprises benzyl alcohol, benzaldehyde, benzophenone, benzoic acid, methyl gentisate, phenacyl chloride, cyclohexenol, cyclohexenone, an allylic alcohol, the ketone, or a combination thereof.

15. The process of claim 1, wherein said water is characterized by a pH that is greater than 7.

16. The process of claim 1, wherein said non-aqueous solvent is a polar aprotic solvent.

17. The process of claim 1, wherein said non-aqueous solvent is oxidatively stable under an applied voltage greater than 1.5 V vs. normal hydrogen electrode (NHE).

18. The process of claim 1, wherein said contacting step is carried out in the presence of a supporting electrolyte that is provided in said non-aqueous solvent.

19. The process of claim 18, wherein said supporting electrolyte is oxidatively stable under an applied voltage greater than 1.5 V vs. normal hydrogen electrode (NHE).

20. The process of claim 1, wherein said anodic bias is selected from the range of 0.5 V to 5 V vs. normal hydrogen electrode (NHE).

21. The process of claim 1, wherein said water oxidation electrocatalyst is immobilized on an anode.

22. The process of claim 1, wherein a cathode is provided in contact with said non-aqueous solvent.

23. The process of claim 1, wherein said hydrocarbon reactant comprises a C—H bond, wherein said C—H bond is oxidized to a C—O bond or a C=O.

24. The process of claim 1, wherein said non-aqueous solvent has a dielectric constant greater than 10, a dipole moment greater than 1.5 debye, or both.

25. The process of claim 1, wherein said anodic bias is applied for a reaction time selected to generate said oxidized hydrocarbon product characterized by a selected product distribution.

26. The process of claim 1, wherein the water oxidation electrocatalyst is miscible or soluble in the non-aqueous solvent.

27. The process of claim 1, wherein the water oxidation electrocatalyst is tethered, linked, or anchored to a solid support to prevent its solubilization or miscibility in the non-aqueous solvent.

28. The process of claim 1, wherein the anodic bias is selected to change the oxidation state of one or more metal ions in the water oxidation electrocatalyst between 4+ and 5+ and/or 6+.

* * * * *